US009175453B2

(12) United States Patent
Alfreds

(10) Patent No.: US 9,175,453 B2
(45) Date of Patent: Nov. 3, 2015

(54) RETAINING WALL SYSTEMS AND METHODS OF CONSTRUCTING SAME

(75) Inventor: Kim L. Alfreds, Blaine, WA (US)

(73) Assignee: Alfreds & Alfreds, Inc., Ferndale, WA (US)

( * ) Notice: Subject to any disclaimer, the term of this patent is extended or adjusted under 35 U.S.C. 154(b) by 0 days.

(21) Appl. No.: 13/195,807

(22) Filed: Aug. 1, 2011

(65) Prior Publication Data

US 2012/0027528 A1 Feb. 2, 2012

Related U.S. Application Data

(60) Provisional application No. 61/369,663, filed on Jul. 30, 2010.

(51) Int. Cl.
*E02D 17/20* (2006.01)
*E02D 29/02* (2006.01)

(52) U.S. Cl.
CPC ..... *E02D 17/20* (2013.01); *E02D 29/02* (2013.01)

(58) Field of Classification Search
CPC . E02D 29/02; E02D 29/0241; E02D 29/0291; E02D 29/0208
USPC ..... 405/15, 17, 19, 21, 107, 110, 111, 115, 405/302.4, 302.6, 302.7, 262, 284
See application file for complete search history.

(56) References Cited

U.S. PATENT DOCUMENTS 1,252,678 A * 1/1918 Farney ..... 405/19
1,597,114 A * 8/1926 Scott ..... 405/19
2,092,183 A * 9/1937 Rehfeld ..... 405/19
2,616,096 A * 11/1952 Hasselquist ..... 4/506
2,653,525 A * 9/1953 McGuire ..... 404/35
3,374,635 A * 3/1968 Crandall ..... 405/18
3,561,219 A * 2/1971 Nishizawa ..... 405/19
3,764,446 A * 10/1973 Martin ..... 428/52
3,837,169 A * 9/1974 Lamberton ..... 405/18
3,886,751 A * 6/1975 Porraz Jimenez Labora 405/107
3,890,802 A * 6/1975 Auriat et al. ..... 405/117
4,154,061 A * 5/1979 Umemoto et al. ..... 405/19

(Continued)

FOREIGN PATENT DOCUMENTS

CA 2268509 A 10/2000
WO 0061880 A 10/2000
WO 2007028228 A 3/2007

OTHER PUBLICATIONS

Acfenvironmental.com, Products section, http://www.acfenvironmental.com/ACFproducts.html.

(Continued)

*Primary Examiner* — Benjamin Fiorello
*Assistant Examiner* — Edwin Toledo-Duran
(74) *Attorney, Agent, or Firm* — Tejpal S. Hansra

(57) ABSTRACT

Retaining wall systems and methods of making retaining wall systems are disclosed. In one embodiment, the retaining wall system includes a first horizontally-extending course of sand/soil bags and a second horizontally-extending course of sand/soil bags positioned vertically adjacent to the first course of sand/soil bags, with an interconnecting member that attaches the first course of sand/soil bags to the second course of sand/soil bags. The interconnecting member has an upper side and a lower side, wherein at least one of the upper side and the lower side has a first projection that includes a notch therein to engage geogrid.

25 Claims, 28 Drawing Sheets

(56) References Cited

U.S. PATENT DOCUMENTS

| | | | | | |
|---|---|---|---|---|---|
| 4,184,788 | A | * | 1/1980 | Colle | 405/19 |
| 4,188,153 | A | * | 2/1980 | Taylor | 405/34 |
| 4,299,514 | A | * | 11/1981 | Muramatsu et al. | 405/115 |
| 4,362,433 | A | * | 12/1982 | Wagner et al. | 405/107 |
| 4,367,978 | A | * | 1/1983 | Schaaf et al. | 405/30 |
| 4,372,705 | A | * | 2/1983 | Atkinson | 405/19 |
| 4,486,115 | A | * | 12/1984 | Rionda et al. | 403/283 |
| 4,555,201 | A | * | 11/1985 | Paoluccio | 405/117 |
| 4,610,568 | A | * | 9/1986 | Koerner | 405/19 |
| 4,661,014 | A | * | 4/1987 | Aubert | 405/111 |
| 4,717,283 | A | * | 1/1988 | Bach | 405/17 |
| 4,729,691 | A | * | 3/1988 | Sample | 405/21 |
| 4,778,309 | A | * | 10/1988 | Bach et al. | 405/284 |
| 4,779,393 | A | * | 10/1988 | Jong | 52/715 |
| 4,787,774 | A | * | 11/1988 | Grove | 405/94 |
| 4,797,026 | A | * | 1/1989 | Webster | 404/28 |
| 4,804,293 | A | * | 2/1989 | Varkonyi et al. | 405/15 |
| 4,906,134 | A | * | 3/1990 | Hoyeck | 405/115 |
| 4,965,097 | A | * | 10/1990 | Bach | 428/194 |
| 4,966,491 | A | * | 10/1990 | Sample | 405/19 |
| 5,059,065 | A | * | 10/1991 | Doolaege | 405/115 |
| 5,091,247 | A | * | 2/1992 | Willibey et al. | 442/46 |
| 5,156,495 | A | * | 10/1992 | Mercer | 405/262 |
| 5,158,395 | A | * | 10/1992 | Holmberg | 405/21 |
| 5,857,806 | A | * | 1/1999 | Melin | 405/115 |
| 5,865,564 | A | * | 2/1999 | Miller et al. | 405/115 |
| 5,934,027 | A | * | 8/1999 | Khalili | 52/167.1 |
| 6,896,449 | B1 | * | 5/2005 | Callinan et al. | 405/284 |
| 7,083,364 | B2 | | 8/2006 | Kim | |
| 7,226,240 | B2 | | 6/2007 | Tyler | |
| 7,258,326 | B2 | * | 8/2007 | Talbott | 256/13.1 |
| 7,452,164 | B2 | | 11/2008 | Kim | |
| 7,452,165 | B2 | | 11/2008 | Tyler | |
| 7,811,029 | B2 | | 10/2010 | Graham et al. | |
| 2006/0257212 | A1 | * | 11/2006 | Kim | 405/284 |
| 2007/0036615 | A1 | | 2/2007 | Kim | |
| 2007/0053752 | A1 | | 3/2007 | Kim | |
| 2007/0110522 | A1 | | 5/2007 | Kim | |
| 2007/0269141 | A1 | * | 11/2007 | Thomson | 383/32 |
| 2008/0092461 | A1 | | 4/2008 | Kim | |
| 2008/0138157 | A1 | | 6/2008 | Kim | |
| 2008/0202073 | A1 | | 8/2008 | Kim | |
| 2008/0247685 | A1 | | 10/2008 | Kim | |

OTHER PUBLICATIONS

Envirolok.com, Home section, http://www.envirolok.com/.

Filtrexx.com, About Filtrexx section, http://www.filtrexx.com/aboutfiltrexx.htm.

* cited by examiner

RETAINING WALL SYSTEMS AND METHODS OF CONSTRUCTING SAME

CROSS-REFERENCE TO RELATED APPLICATION

This application claims the benefit of U.S. Provisional Application No. 61/369,663, filed Jul. 30, 2010, which is incorporated herein by reference in its entirety.

FIELD OF THE INVENTION

The present invention relates generally to retaining walls and to methods of constructing retaining walls. In particular, it pertains to retaining walls built of units such as sand/soil bags, wherein units in adjacent courses are connected together.

BACKGROUND OF THE INVENTION

U.S. Pat. No. 7,083,364 to Kim entitled "Retaining Wall System With Interlocked Wall-Building Units" describes retaining walls that are used in a wide variety of civil engineering and landscaping applications including, for example, to support slopes and embankments for highways and railways, and to support noise barriers, among other things. More specifically, U.S. Pat. No. 7,083,364 describes a permanent retaining wall structure in which wall building units, such as sand/soil bags, used to make the face of the structure are attached to wall building units in adjacent courses, and preferably to geogrid sheets. Attachment is achieved using an interconnecting member (in the form of a plate) having projections on both sides thereof, which protrude into the wall building units in adjacent courses. The projections also protrude through holes in the geogrid sheets, stabilizing the retaining wall structure and backfill. U.S. Pat. No. 7,083,364 is incorporated herein by reference in its entirety.

A conventional interconnecting member 10 is illustrated in FIGS. 1 and 2, where FIG. 1 is a top isometric view and FIG. 2 is a bottom isometric view. The interconnecting member takes the form of a rectangular plate and includes an upper side 12 and a lower side 14.

Both the upper side 12 and the lower side 14 of the interconnecting member 10 include a plurality of projections 16 in the form of spikes that are used to protrude into sand/soil bags 20, as will be described in connection with FIGS. 3A, 3B, 4A, 4B and 5. The sand/soil bags 20 are made of a geotextile material, which is durable, permits water to flow in and through the bag, and permits seedlings to grow out, while retaining fine soil particles therein. The term sand/soil bag means a bag (or cover) filled with any suitable fill material, including sand, soil, and mixtures thereof, and may also include fill mixed with seeds for grass or other plants.

An exploded front elevation view of a conventional retaining wall system 30 is shown in FIG. 3A, while FIG. 3B is diagrammatic representation of an exploded right end elevation view of the retaining wall system 30. As shown in the figures, the retaining wall system 30 includes a first course 40 of sand/soil bags 20 that extend horizontally and a second course 50 of sand/soil bags (only one bag is shown), which also extend horizontally, but are also vertically adjacent to the first course 40. The first course 40 of sand/soil bags 20 and second course 50 of sand/soil bags are connected to one another by interconnecting members 10.

FIG. 4A is a front elevation view of an assembled retaining wall system 30, while FIG. 4B is a right end elevation view of the retaining wall system 30. FIG. 5 is a cross-sectional view taken along line 5-5 of FIG. 4A, which shows an interconnecting member 10 engaging two vertically adjacent sand/soil bags 20.

Referring to FIGS. 4A, 4B and 5, interconnecting members 10 are used to construct the retaining wall system 30 by placing them on top of sand/soil bags 20 in a (first) course 40 so that projections on the lower side protrude into the bags. A second course 50 of sand/soil bags is placed on top of the first course and of interconnecting members 10. The projections 16 on the upper side of interconnecting member 10 protrude into the sand/soil bags of the second course 50, and the weight of the sand/soil bags acts on the interconnecting members 10, so that the projections 16 on the lower side 14 protrude into the sand/soil bags 20 in the first course 40. The projections 16 can be configured to fully penetrate the sand/soil bags 20 or to simply indent them. In either case, the projections 16 are considered to "protrude" into the bags.

Interconnecting members 10 are also used to anchor geogrid sheets to the sand/soil bags 20. Geogrid sheets are known and commercially available plastic mesh products commonly used for soil reinforcement and have a plurality of holes therein. Geogrid sheets are affixed to the face of a retaining wall by placing an edge of the sheet over interconnecting members 10 atop a course of sand/soil bags 20, so that the projections 16 on the upper side 12 of the interconnecting member protrude through the holes in the geogrid. When the next course of sand/soil bags 20 is put on top, projections 16 on the upper side of the interconnecting member 10, which already extend through the geogrid, protrude into the underside of the sand/soil bags 20 in the upper course.

Instead of being placed over an interconnecting member 10, a geogrid sheet may be placed directly on top of a course of sand/soil bags 20 with interconnecting members 10 placed over it. In such case, the projections 16 on the lower side 14 of the interconnecting member 10 would protrude down through the holes in the geogrid sheet and into the sand/soil bags 20. In other words, the geogrid may be placed under the interconnecting member 10 instead of over it.

As shown and described in connection with FIGS. 1-5, the projections 16, which are designed to protrude into the sand/soil bags 20 are linearly tapered until they reach a point, wherein the point is furthest away from the face of the upper side 12 (or lower side 14). When forces act on the geogrid, there is some concern that the geogrid will slide off of one or more of the projections 16.

In order to address this concern, U.S. Pat. No. 7,083,364 describes a geogrid holding members that are have a cap, are L-shaped or have a taper that increases as the distance from the face of the upper side 12 (or lower side 14) is increased. The geogrid holding members in the '364 patent are disadvantageous for a number of reasons. For example, using geogrid holding members adds cost since additional material must be used to construct same. As another example, using geogrid holding members may reduce stackability of interconnecting members during shipping.

Accordingly, it would be desirable to develop an interconnecting member which reliably secures geogrid using projections, but without requiring separate geogrid holding members that may reduce stackability.

It would also be desirable to develop an interconnecting member which reduces the likelihood of poor interconnection between vertically adjacent sand/soil bags.

It would also be desirable to permit interconnecting members to be attached to one another in a linear and/or transverse configuration.

It would also be desirable to allow more flexibility in creating retaining wall structures by permitting straps to be attached to interconnecting members.

It would also be desirable to develop more permanent connections between interconnecting members and sand/soil bags.

It would also be desirable to modify the shape of interconnecting members, so as to increase the opportunity for plant growth and reduce the likelihood of obstructing plant growth.

SUMMARY OF THE INVENTION

The present invention is designed to address at least one of the aforementioned problems and/or meet at least one of the aforementioned needs.

Retaining wall systems and methods of making retaining wall systems are disclosed. In one embodiment, the retaining wall system includes a first horizontally-extending course of sand/soil bags and a second horizontally-extending course of sand/soil bags positioned vertically adjacent to the first course of sand/soil bags, with an interconnecting member that attaches the first course of sand/soil bags to the second course of sand/soil bags. The interconnecting member has an upper side and a lower side, wherein at least one of the upper side and the lower side has a first projection that includes a notch therein to engage geogrid.

Other objects, features, embodiments and/or advantages of the invention will be apparent from the following specification taken in conjunction with the following drawings.

DETAILED DESCRIPTION

Figure 6:
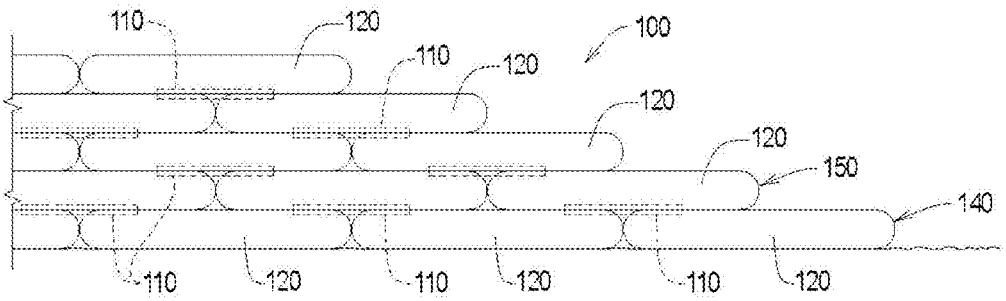
FIG. 6 is a diagrammatic representation of a front elevation view of an exemplary retaining wall with interconnecting members shown schematically in broken lines.
Figure 7:
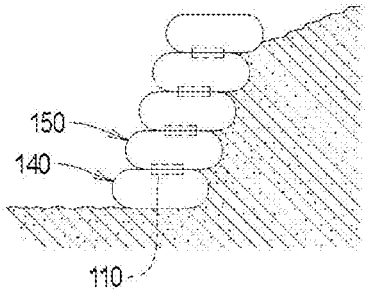
FIG. 7 is a diagrammatic representation of a right end elevation view of the exemplary retaining wall of FIG. 6 with interconnecting members shown in broken lines.

FIG. 6 is a front elevation view of an exemplary retaining wall system 100 with interconnecting members 110 shown schematically in broken lines, while FIG. 7 is a right end elevation view of the exemplary retaining wall system 100. Interconnecting members 110 are used to attach vertically adjacent sand/soil bags 120 to one another.

As used herein, sand/soil bag 120 means a bag (or cover) filled with any suitable fill material including sand, soil and mixtures thereof. The fill material may also include seeds for grass and other plants.

In one embodiment, the retaining wall system 100 includes a first plurality of sand/soil bags 120 positioned adjacent to one another forming a first, horizontally-extending course 140; a second plurality of sand/soil bags 120 positioned adjacent to one another and above the first course 140 to form a second, horizontally-extending course 150; and, interconnecting members 110 placed between the first and second courses 140, 150 to attach them together.

It should be understood that the interconnecting members 110 are not limited to positions shown in FIG. 6. Instead, the interconnecting members 110 can be positioned anywhere between the first course 140 and the second course 150.

It should also be understood that the terms first course 140 and second course 150 are not limited to the lowermost course and the course immediately vertically above it. Instead, first course and second course merely represent two courses of sand/soil bags, wherein at least one sand/soil bag of the first course forms no part of the second course.

Several embodiments of the invention are disclosed herein, including several embodiments of the interconnecting member 110.

Figure 5:
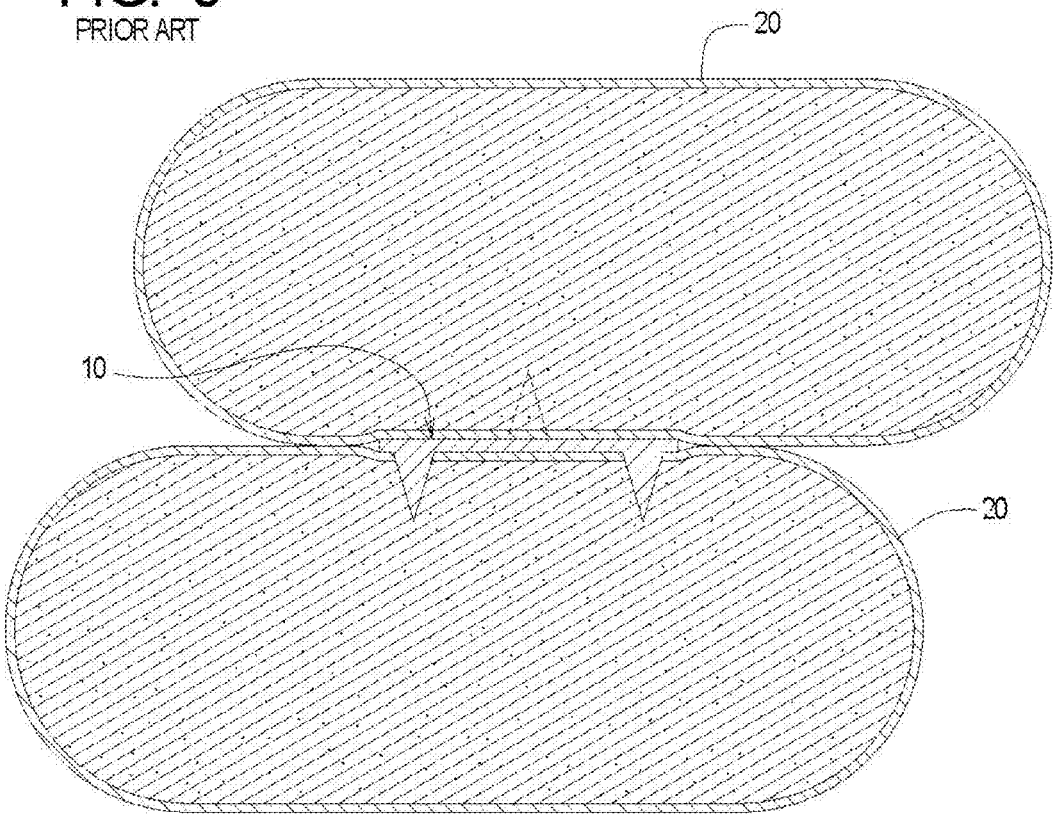
FIG. 5 PRIOR ART
FIG. 5 is a cross-sectional view taken along line 5-5 of FIG. 4A, which shows an conventional interconnecting member engaging two vertically adjacent sand/soil bags.
Figure 8:
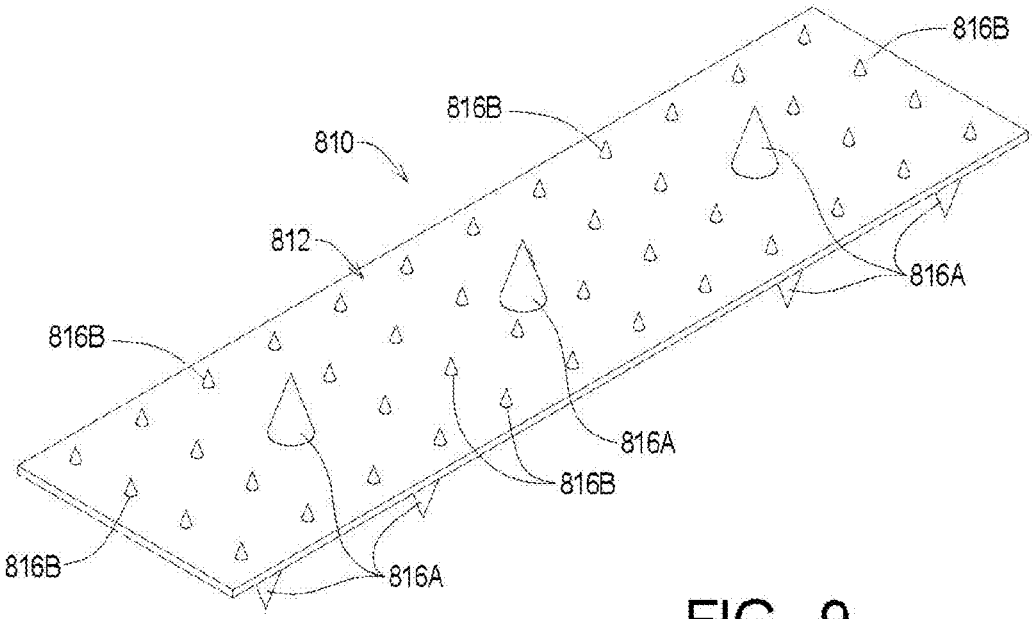
FIG. 8 is a diagrammatic representation of an isometric top view of a first exemplary interconnecting member in accordance with an embodiment of the invention.
Figure 9:
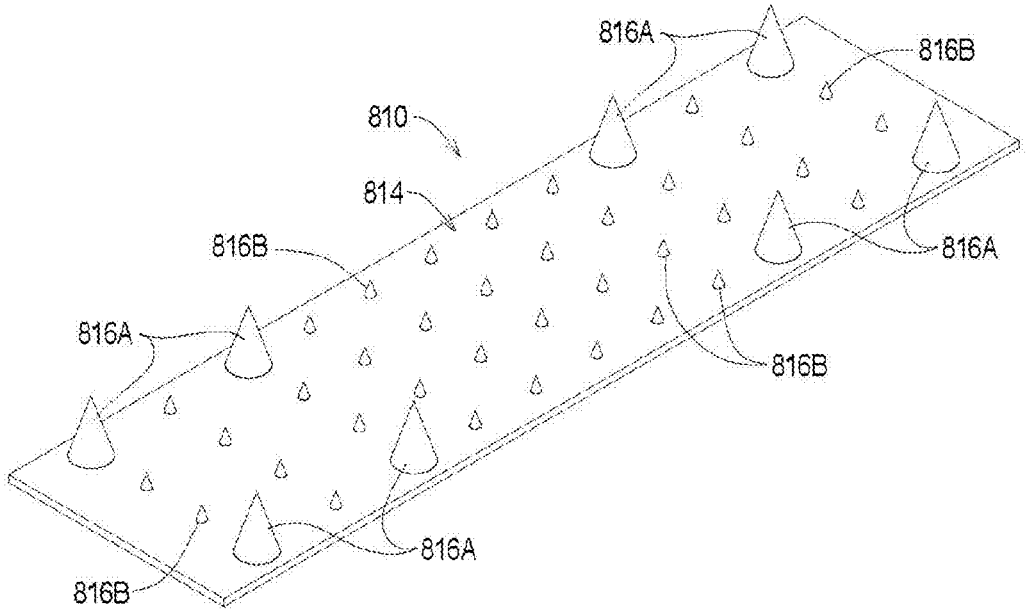
FIG. 9 is a diagrammatic representation of an isometric bottom view of the interconnecting member of FIG. 8.
Figure 10:
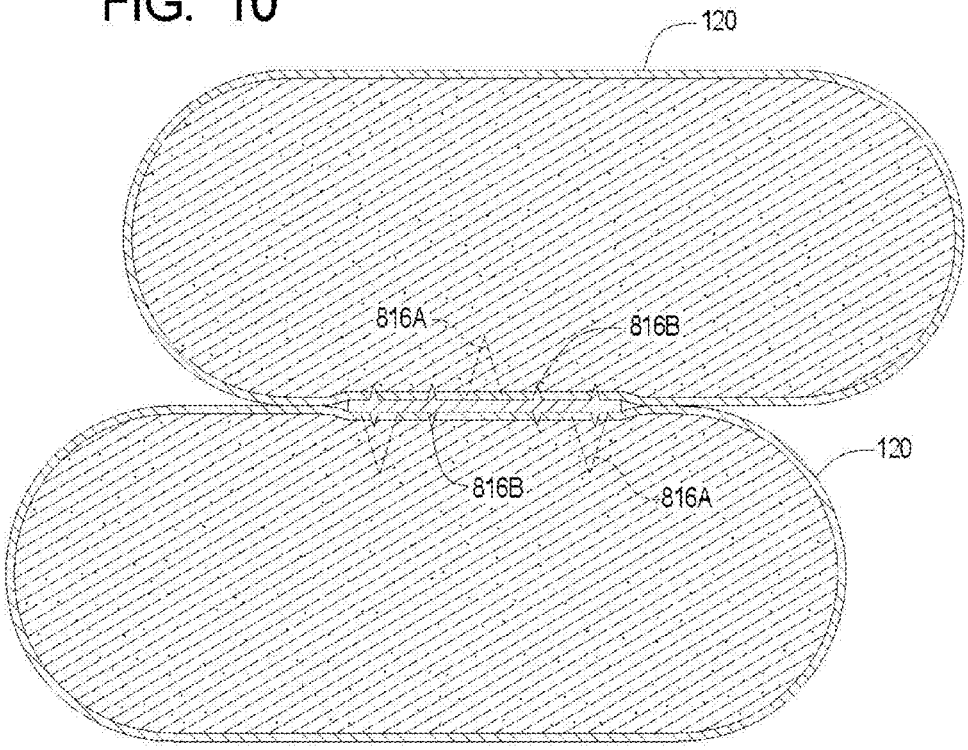
FIG. 10 is a diagrammatic representation of a cross-sectional view, similar to FIG. 5, which shows an interconnecting member of FIGS. 8 and 9 engaging two sand/soil bags.

FIG. 8 is an isometric top view of a first exemplary interconnecting member 810 of the invention, while FIG. 9 is an isometric bottom view of the interconnecting member 810. FIG. 10 is a cross-sectional view, similar to FIG. 5, which shows the interconnecting member 810 of FIGS. 8 and 9 engaging two sand/soil bags 120.

Figure 1:
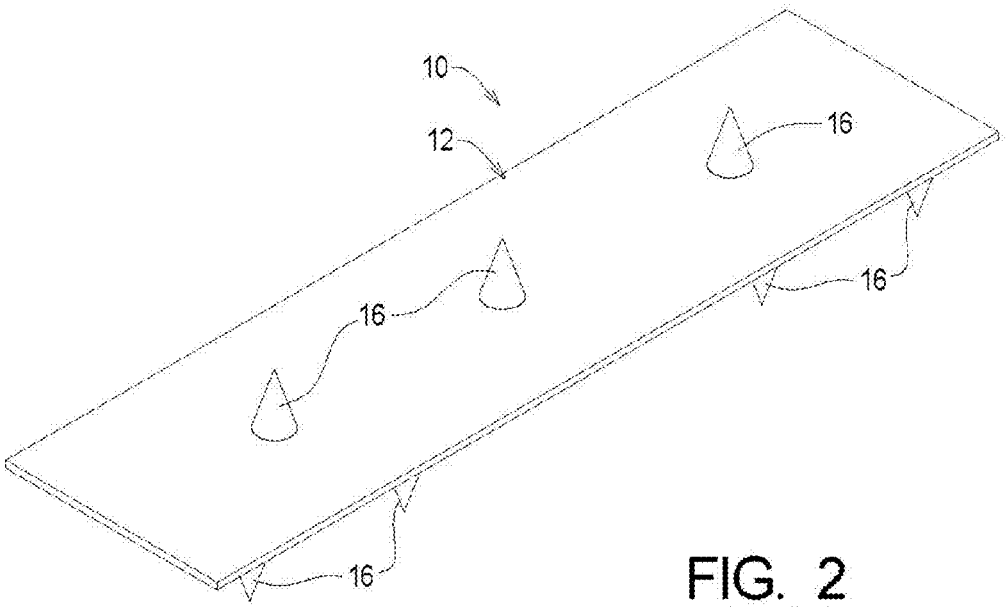
FIG. 1 PRIOR ART
FIG. 1 is a diagrammatic representation of an isometric top view of a conventional interconnecting member.
Figure 2:
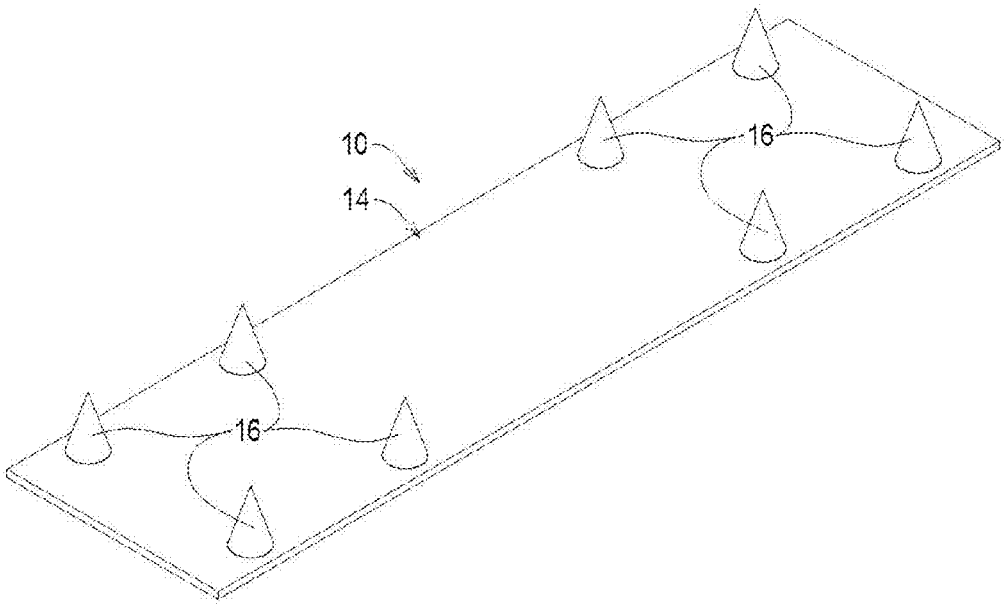
FIG. 2 PRIOR ART
FIG. 2 is a diagrammatic representation of an isometric bottom view of the conventional interconnecting member shown in FIG. 1.
Figure 3A:
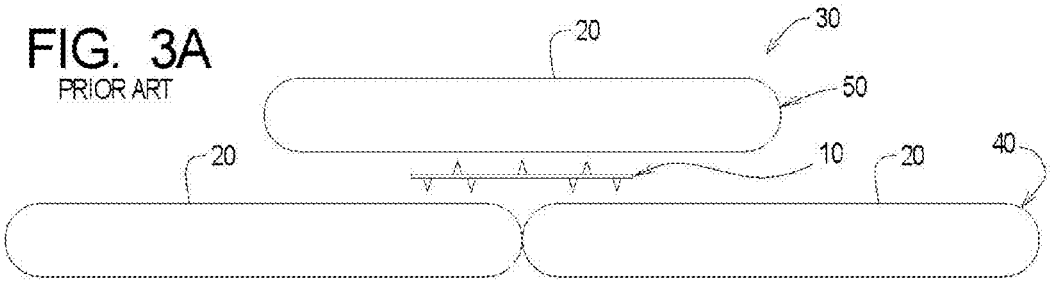
FIG. 3A PRIOR ART
FIG. 3A is diagrammatic representation of an exploded front elevation view of a conventional retaining wall system.
Figure 3B:
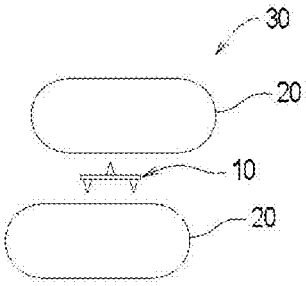
FIG. 3B PRIOR ART
FIG. 3B is diagrammatic representation of an exploded right end elevation view of the conventional retaining wall system shown in FIG. 3A.
Figure 4A:
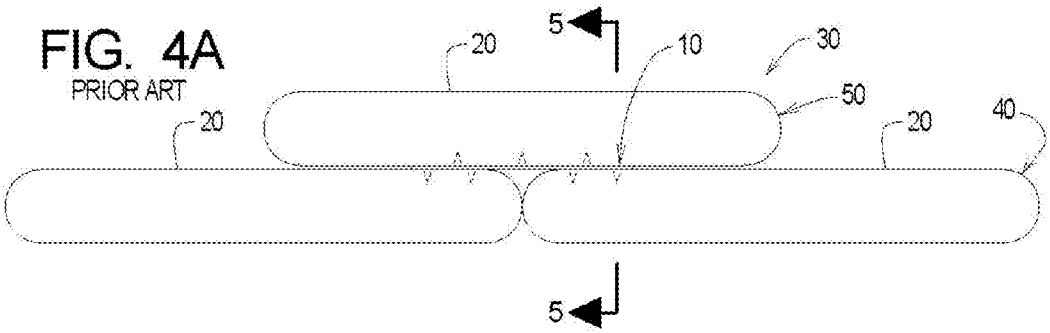
FIG. 4A PRIOR ART
FIG. 4A is a diagrammatic representation of a front elevation view of the conventional retaining wall system shown in FIG. 3A.
Figure 4B:
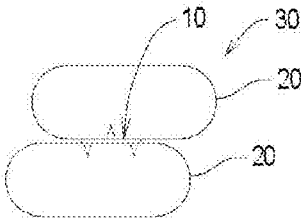
FIG. 4B PRIOR ART
FIG. 4B is a diagrammatic representation of a right end elevation view of the conventional retaining wall system shown in FIG. 3A.

As shown in FIGS. 8-10, the interconnecting member 810 includes an upper side 812 and a lower side 814. In contrast to the projections 16 shown in FIGS. 1 and 2, both the upper side 812 and the lower side 814 have first projections 816A and second projections 816B extending therefrom, wherein the first projections 816A are larger than the second projections 816B.

More specifically, first projections 816A are "larger" than second projections 816B in at least one of the three main dimensions. That is, first projections 816A have at least a greater height (e.g., in a vertical direction or z-axis), a greater width (e.g., in a first horizontal direction or y-axis) and/or greater depth (e.g., in a second horizontal direction perpendicular to the first horizontal direction or x-axis) than second projections 816B. In the exemplary embodiment shown in FIGS. 8-10, the first projections 816A are larger than second projections 816B in all three dimensions.

Without being bound by any theory, using second projections 816B in combination with first projections 816A is believed to increase the strength of attachment (in, at least, some instances) between sand/soil bags 120 that are connected by interconnecting member 810, as compared to sand/soil bags 120 that are connected by interconnecting member 10 of FIGS. 1-5. Accordingly, the overall strength of retaining wall system 100 is believed to be improved.

The first projections 816A and second projections 816B of FIGS. 8-10 have a spike shape. It should be understood that the shape of the first projections 816A may be different from the shape of the second projections 816B. It should also be understood that projections of more than two different shapes may be used. Furthermore, it should be understood that first and second projections 816A, 816B may be provided on only one of upper side 812 and lower side 814, instead of both. In addition, it should be understood that projections of more than two different sizes may be used.

In one embodiment, there are at least twice as many second projections 816B as there are first projections 816A (e.g., on upper side 812, on lower side 814 or a combination of both). In other embodiments, there are at least three times, four times, ten times or twenty times as many second projections 816B as there are first projections 816A.

It should be understood that positions of the first and second projections 816A, 816B (either individually or relative to each other) are not limited to the positions shown in FIGS. 8-10. In one embodiment, first projections on the lower side 814 are spaced sufficiently so that they engage adjacent sand/soil bags 120 in a first course 140 and first projections on the upper side 812 engage a single sand/soil bag 120 in a second course 150 that is vertically adjacent to the first course 140 (see, e.g., FIG. 6).

In one embodiment, the height of the first projections 816A is at least twice the height of the second projections 816B. In one embodiment, the largest diameter of the first projections 816A is at least twice the largest diameter of the second projections 816B. In one embodiment, the height of the first projections 816A is at least four times the height of the second projections 816B. In one embodiment, the largest diameter of the first projections 816A is at least four times the largest diameter of the second projections 816B. In one embodiment, the height of the first projections 816A is at least eight times the height of the second projections 816B. In one embodiment, the largest diameter of the first projections 816A is at least eight times the largest diameter of the second projections 816B.

Figure 13:
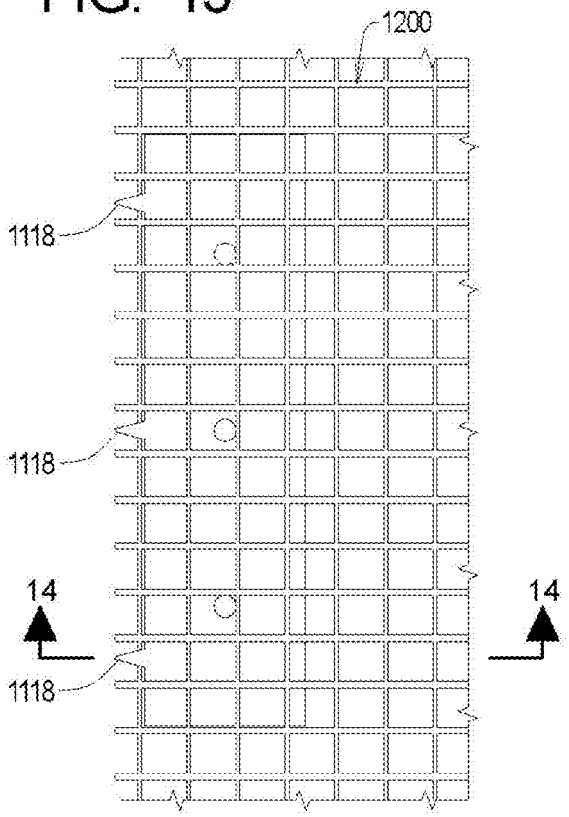
FIG. 13 is a diagrammatic representation of a top plan view of the interconnecting member of FIG. 11 with geogrid engaged therewith.
Figure 19:
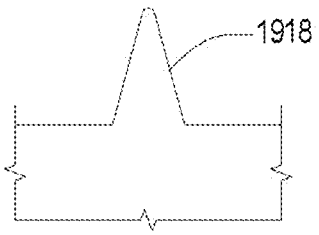
FIG. 19 is a diagrammatic representation of a top plan view of a portion of an interconnecting member, which illustrates a first exemplary shape of a geogrid holding member.
Figure 25:
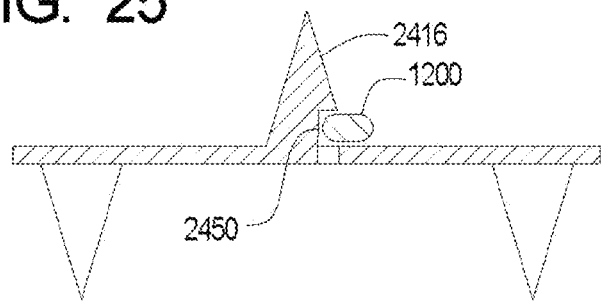
FIG. 25 is a diagrammatic representation of a cross-sectional view of the interconnecting member of FIG. 24 taken along line 25-25 of FIG. 24 showing a geogrid engaged by the interconnecting member.

U.S. Pat. No. 7,083,364 ("the '364 patent") describes various geogrid-holding members that are part of their respective interconnecting members. In each case, the geogrid-holding members extend in the same direction as the spike-shaped projections of the interconnecting members and are designed to securely attach the geogrid and to prevent the geogrid from becoming disengaged therefrom. Accordingly, the geogrid-holding members have a relatively blunt or flat portion that contacts the sand/soil bag (e.g., a cylindrical shape (or mushroom shape when a cap is used) as shown in FIG. 13 of the '364 patent, an upside down L-shape as shown in FIG. 19 of the '364 patent and tapered shape with a wide top and narrow base as shown in FIG. 25 of the '364 patent). The relatively blunt or flat portion of the geogrid-holding members may interfere with the connection between an interconnecting member and a sand/soil bag. Furthermore, the position of the geogrid-holding members may also reduce the stackability of the interconnecting members when they are being transported.

Figure 11:
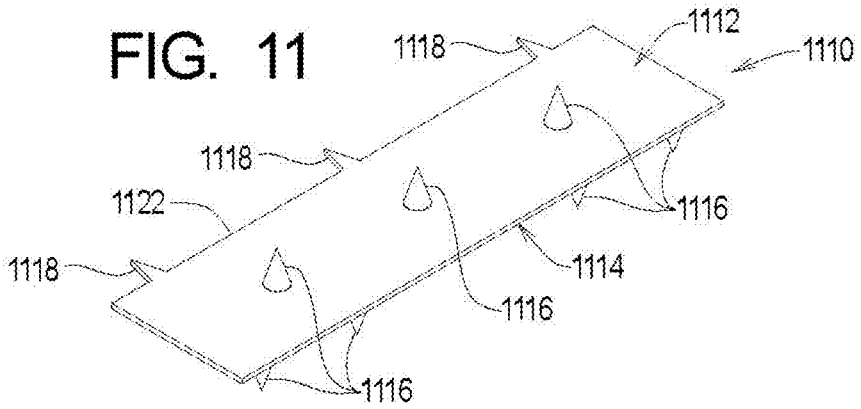
FIG. 11 is a diagrammatic representation of an isometric top view of a second exemplary interconnecting member in accordance with an embodiment of the invention.

FIG. 11 is an isometric top view of a second exemplary interconnecting member 1110 in accordance with an embodiment of the invention. The interconnecting member includes an upper side 1112, a lower side 1114, projections 1116 and geogrid-holding members 1118.

In order to reduce the likelihood of interference with the connection between the interconnecting member 1110 and a sand/soil bag 120, the geogrid-holding members 1118 extend along a first edge 1122 in a direction parallel to the upper side 1112 (or lower side 1114). Stated differently, the geogrid-holding members 1118 extend along a first edge 1122 in a direction that is generally perpendicular to the direction in which the projections 1116 extend.

In one embodiment, geogrid-holding members 1118 are designed to engage geogrid having a variety of mesh thicknesses. To explain further, there are many manufacturers of geogrid. However, there does not appear to be any type of standardization of geogrid mesh thicknesses between manufacturers. Accordingly, when determining the position of geogrid-holding members, geogrid having a variety of mesh thicknesses are overlaid (either actually or diagrammatically) and the final position of the geogrid-holding members are determined to accommodate geogrid mesh thicknesses of interest.

In one embodiment, the geogrid-holding members 1118 of the present invention have a generally saw tooth shape with a pointed tip. This allows a larger number of geogrid mesh thicknesses to be accommodated as compared to the thicker, blunt-ended geogrid-holding members of the '364 patent.

Figure 12:
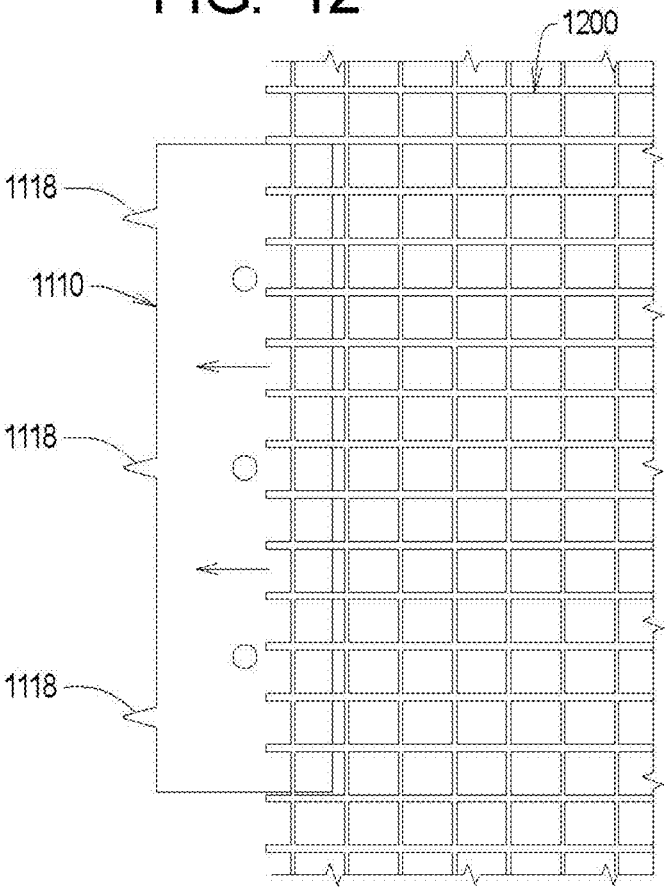
FIG. 12 is a diagrammatic representation of a top plan view of the interconnecting member of FIG. 11 with geogrid being placed over it.

FIG. 12 is a top plan view of the interconnecting member 1110 of FIG. 11 with geogrid 1200 being placed over it. In such case, the interconnecting member 1110 has been placed over a sand/soil bag 120 prior to the geogrid 1200 being moved into place. It should be understood, however, that geogrid 1200 may be laid down first, which would then be followed by interconnecting member 1110.

Figure 14:
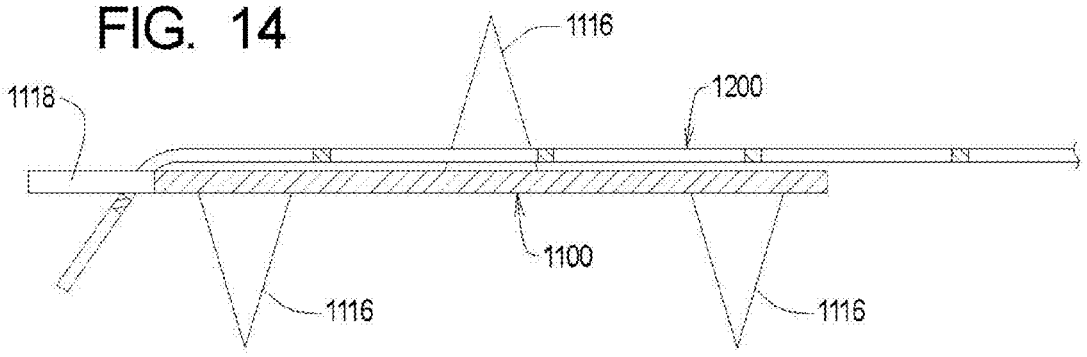
FIG. 14 is a diagrammatic representation of a magnified cross-sectional view taken along line 14-14 of FIG. 13 showing geogrid in engagement with the interconnecting member.

FIG. 13 is a top plan view of the interconnecting member 1110 of FIG. 11 with geogrid 1200 engaged therewith. FIG. 14 is a magnified cross-sectional view taken along line 14-14 of FIG. 13 showing geogrid 1200 in engagement with the interconnecting member 1110.

Figure 15:
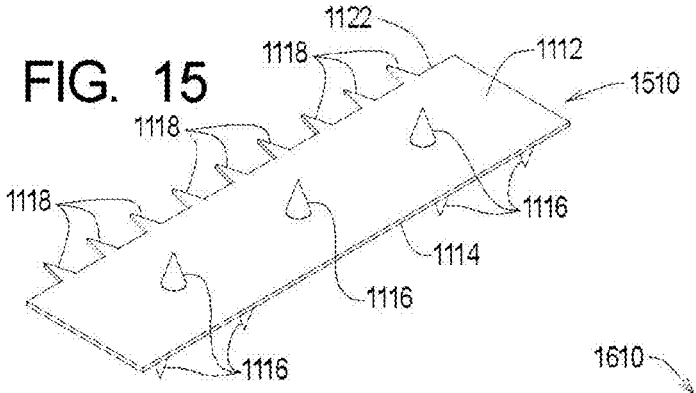
FIG. 15 is a diagrammatic representation of an isometric top view of a third exemplary interconnecting member in accordance with an embodiment of the invention.

FIG. 15 is an isometric top view of a third exemplary interconnecting member 1510 in accordance with an embodiment of the invention. The embodiment of FIG. 15 is similar to the interconnecting member 1110 shown in FIG. 11, except that it illustrates that the number of geogrid-holding members 1118 is not limited to three and the position of the geogrid-holding members 1118 is not limited to that shown in FIG. 11.

Figure 16:
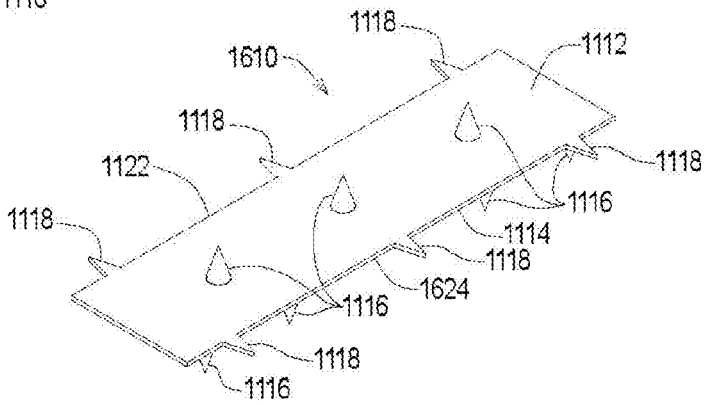
FIG. 16 is a diagrammatic representation of an isometric top view of a fourth exemplary interconnecting member in accordance with an embodiment of the invention.

FIG. 16 is an isometric top view of a fourth exemplary interconnecting member 1610 in accordance with an embodiment of the invention. The embodiment of FIG. 16 is similar to the interconnecting member 1110 shown in FIG. 11, except that it illustrates that the geogrid-holding members 1118 may extend from second edge 1624 in addition to first edge 1122.

Figure 17:
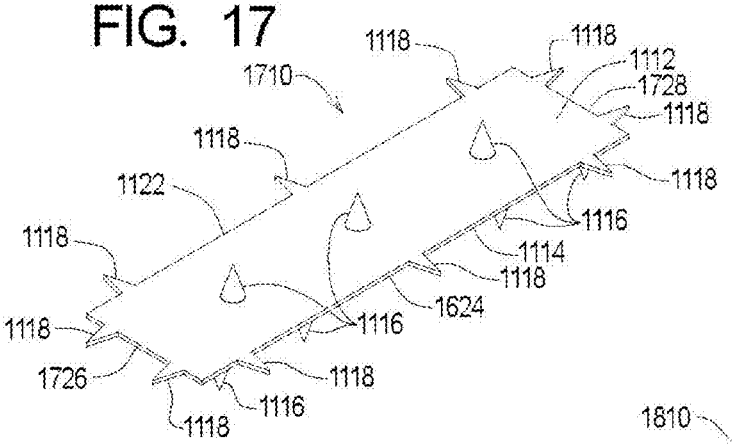
FIG. 17 is a diagrammatic representation of an isometric top view of a fifth exemplary interconnecting member in accordance with an embodiment of the invention.

FIG. 17 is an isometric top view of a fifth exemplary interconnecting member 1710 in accordance with an embodiment of the invention. The embodiment of FIG. 17 is similar to the interconnecting member 1610 shown in FIG. 16, except that it illustrates that the geogrid-holding members 1118 may extend from third edge 1726 and fourth edge 1728 in addition to first edge 1122 and second edge 1624.

Figure 18:
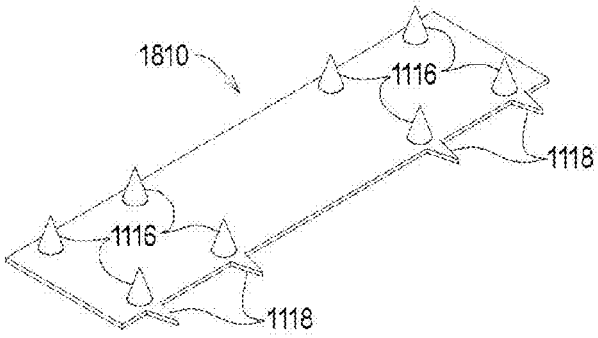
FIG. 18 is a diagrammatic representation of an isometric top view of a sixth exemplary interconnecting member in accordance with an embodiment of the invention.

FIG. 18 is a diagrammatic representation of an isometric top view of a sixth exemplary interconnecting member 1810 in accordance with an embodiment of the invention. Other exemplary locations of the geogrid-holding members 1118 are shown in FIG. 18.

FIG. 19 is a diagrammatic representation of a top plan view of a portion of an interconnecting member 1918, which illustrates a first exemplary shape of a geogrid holding member.

Figure 20:
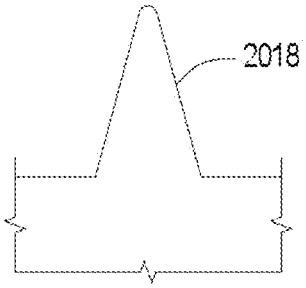
FIG. 20 is a diagrammatic representation of a top plan view of portion of an interconnecting member, which illustrates a second exemplary shape of a geogrid holding member.

FIG. 20 is a diagrammatic representation of a top plan view of portion of an interconnecting member, which illustrates a second exemplary shape 2018 of a geogrid holding member. Although the overall shape of the geogrid holding member 2018 in FIG. 20 is similar to the shape of the geogrid holding member 1918 in FIG. 19, FIGS. 19 and 20 illustrate that the size of geogrid holding member may vary. Furthermore, it should be understood that a single interconnecting member may include geogrid holding members of multiple shapes and sizes.

Figure 21:
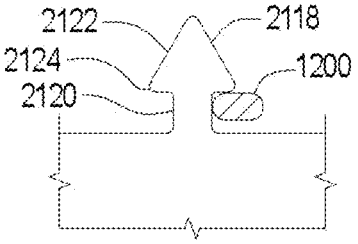
FIG. 21 is a diagrammatic representation of a top plan view of a portion of an interconnecting member, which illustrates a third exemplary shape of a geogrid holding member with a portion of geogrid in cross-section.

FIG. 21 is a diagrammatic representation of a top plan view of a portion of an interconnecting member, which illustrates a third exemplary shape of a geogrid holding member 2118 with a portion of geogrid 1200 in cross-section. The geogrid holding member 2118 includes a cylindrical shaft 2120 and a conical upper portion 2122. The diameter of the base 2124 of the conical upper portion 2122 is greater than the diameter of the cylindrical shaft 2120, which assists the geogrid holding member 2118 in engaging the geogrid.

Figure 22:
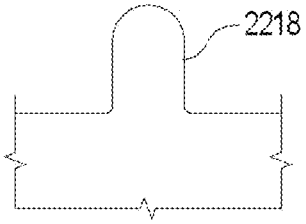
FIG. 22 is a diagrammatic representation of a top plan view of a portion of an interconnecting member, which illustrates a fourth exemplary shape of a geogrid holding member.

FIG. 22 is a diagrammatic representation of a top plan view of a portion of an interconnecting member, which illustrates a fourth exemplary shape of a geogrid holding member 2218.

Figure 23:
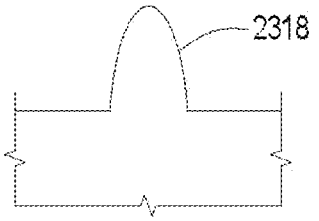
FIG. 23 is a diagrammatic representation of a top plan view of a portion of an interconnecting member, which illustrates a fifth exemplary shape of a geogrid holding member.

FIG. 23 is a diagrammatic representation of a top plan view of a portion of an interconnecting member, which illustrates a fifth exemplary shape of a geogrid holding member 2318.

Figure 24:
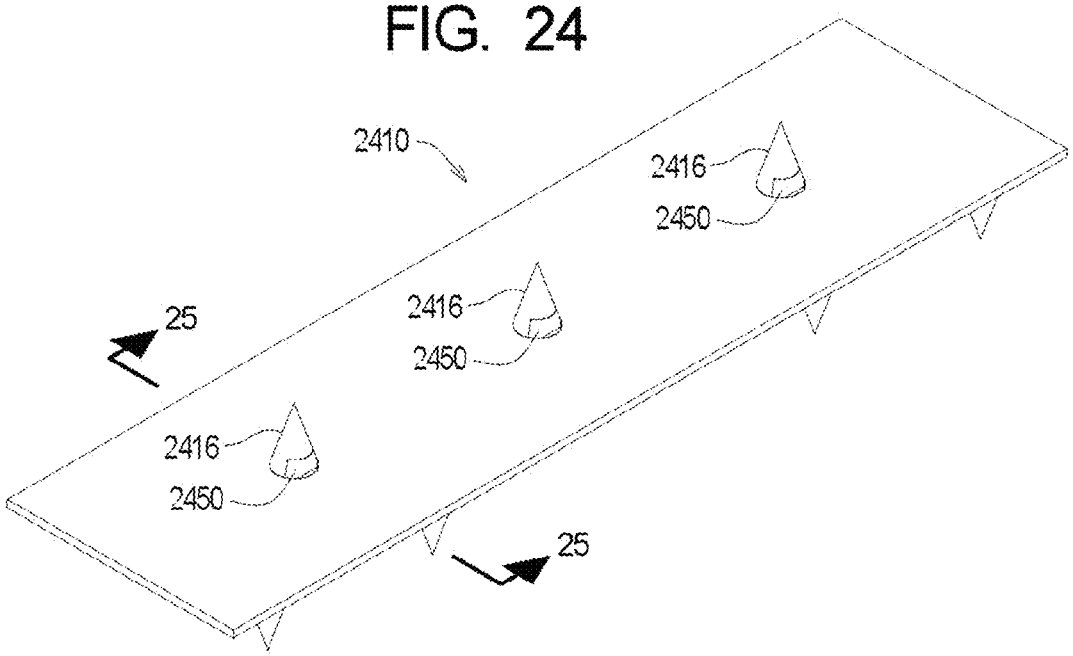
FIG. 24 is a diagrammatic representation of an isometric top view of a seventh exemplary interconnecting member in accordance with an embodiment of the present invention.

FIG. 24 is a diagrammatic representation of an isometric top view of a seventh exemplary interconnecting member 2410 in accordance with an embodiment of the present invention. The interconnecting member 2410 includes one or more projections 2416 with undercuts or notches 2450 that are used to engage geogrid 1200.

FIG. 25 is a diagrammatic representation of a cross-sectional view of the interconnecting member 2410 of FIG. 24 taken along line 25-25 of FIG. 24 showing geogrid 1200 engaged by the interconnecting member 2410.

Figure 26:
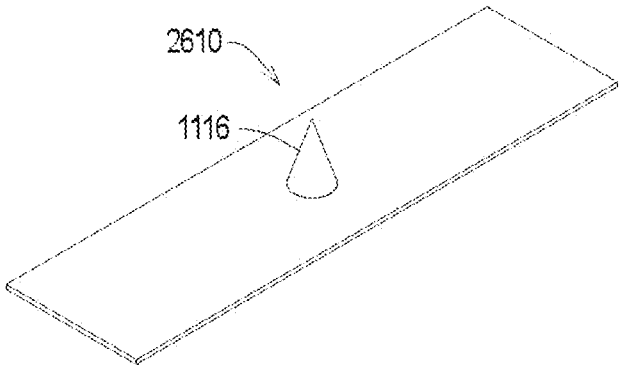
FIG. 26 is a diagrammatic representation of an isometric top view of an eighth exemplary interconnecting member in accordance with the invention.
Figure 27:
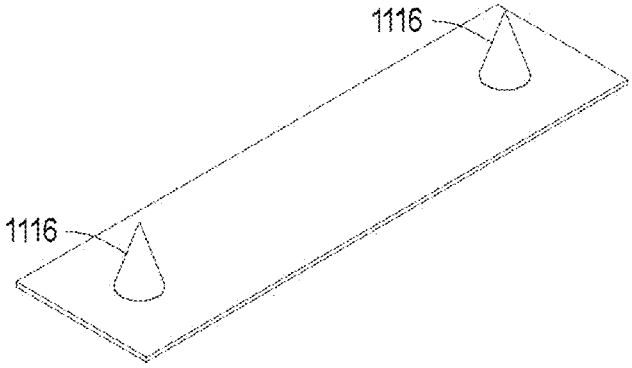
FIG. 27 is a diagrammatic representation of an isometric bottom view of the exemplary interconnecting member shown in FIG. 26.
Figure 28:
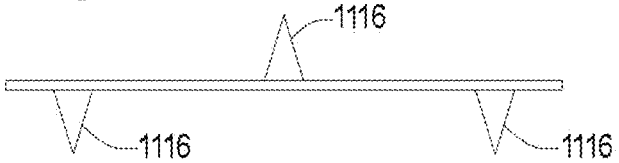
FIG. 28 is a diagrammatic representation of a front elevation view of the exemplary interconnecting member shown in FIG. 26.

FIG. 26 is a diagrammatic representation of an isometric top view of an eighth exemplary interconnecting member 2610 in accordance with one embodiment of the invention. FIG. 27 is a diagrammatic representation of an isometric bottom view of the exemplary interconnecting member 2610 shown in FIG. 26. FIG. 28 is a diagrammatic representation of a front elevation view of the exemplary interconnecting member 2610 shown in FIG. 26.

Figure 29:
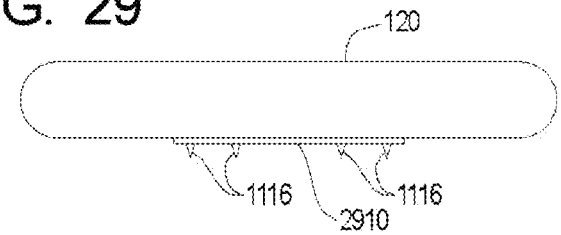
FIG. 29 is a diagrammatic representation of a front elevation view of an interconnecting member mechanically attached to a sand/soil bag.

FIG. 29 is a diagrammatic representation of a front elevation view of an interconnecting member 2910 mechanically attached to a sand/soil bag 120.

Figure 30:
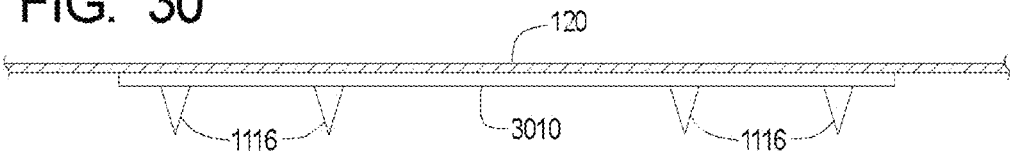
FIG. 30 is a diagrammatic representation of a partial cross-sectional front elevation view of an interconnecting member ultrasonically welded to a sand/soil bag.

FIG. 30 is a diagrammatic representation of a partial cross-sectional front elevation view of an interconnecting member 3010 ultrasonically welded to a sand/soil bag 120.

Figure 31:
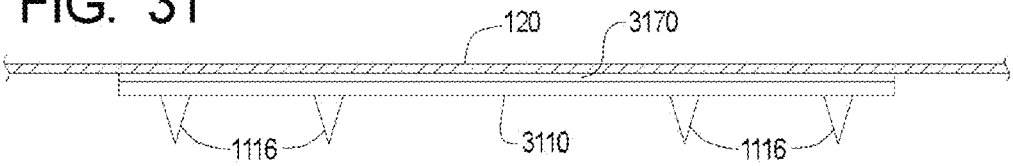
FIG. 31 is a diagrammatic representation of a partial cross-sectional front elevation view of an interconnecting member attached to a sand/soil bag with adhesive.

FIG. 31 is a diagrammatic representation of a partial cross-sectional front elevation view of an interconnecting member 3110 attached to a sand/soil bag 120 with adhesive 3170.

Figure 32:
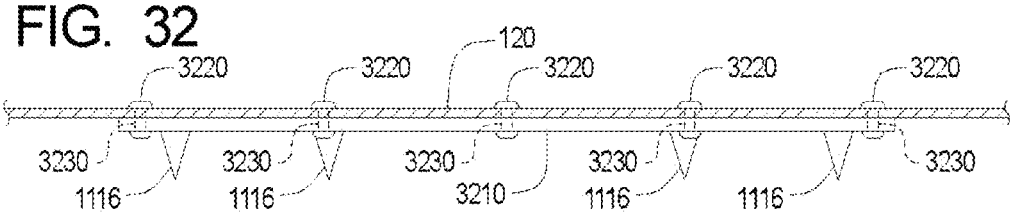
FIG. 32 is a diagrammatic representation of a partial cross-sectional front elevation view of an interconnecting member attached to a sand/soil bag with a plurality of rivets.

FIG. 32 is a diagrammatic representation of a partial cross-sectional front elevation view of an interconnecting member 3210 attached to a sand/soil bag 120 with a plurality of rivets 3220. In this embodiment, the interconnecting member 3210 includes a plurality of apertures 3230 that correspond with the plurality of rivets 3220.

Figure 33:
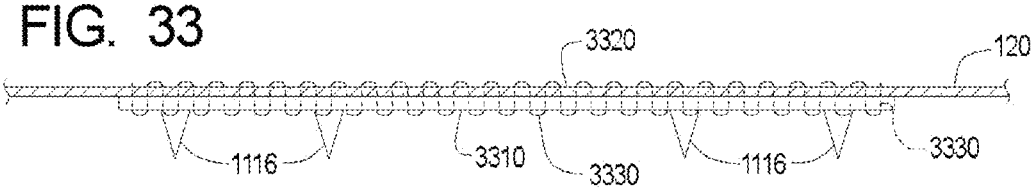
FIG. 33 is a diagrammatic representation of a partial cross-sectional front elevation view of an interconnecting member attached to a sand/soil bag with a thread.

FIG. 33 is a diagrammatic representation of a partial cross-sectional front elevation view of an interconnecting member 3310 attached to a sand/soil bag 120 with a thread 3320. In this embodiment, the interconnecting member 3310 includes a plurality of apertures 3330 through which the thread 3320 can pass.

Figure 34:
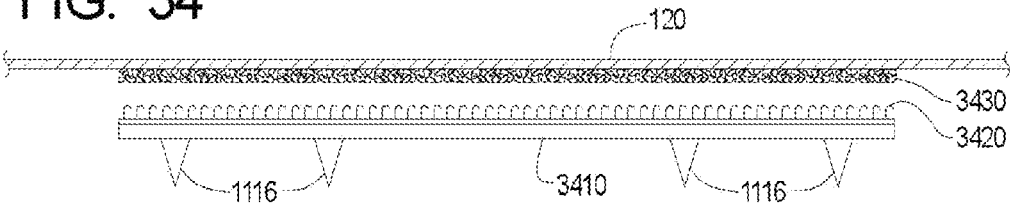
FIG. 34 is a diagrammatic representation of a partial cross-sectional front elevation view of an interconnecting member with Velcro hooks and a sand/soil bag with Velcro loop strips which work in combination to attach the interconnecting member to the sand/soil bag.

FIG. 34 is a diagrammatic representation of a partial cross-sectional front elevation view of an interconnecting member 3410 with Velcro hooks 3420 and a sand/soil bag 120 with Velcro loop strips 3430 which work in combination with one another to attach the interconnecting member 3410 to the sand/soil bag 120. The Velcro loop strips 3430 are attached to the sand/soil bag 120, for example, using adhesive or thread, or by ultrasonic welding. Other techniques of attaching the Velcro loop strips 3430 are possible and anticipated.

FIGS. 35-47 illustrate a plurality of exemplary spike assemblies which may replace or be used in conjunction with one or more interconnecting members. Furthermore, two or more of the exemplary spike assemblies may be used together.

Figure 35:
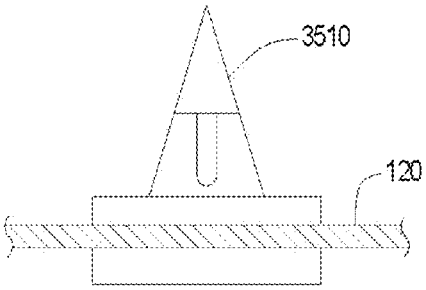
FIG. 35 is a diagrammatic representation of a partial cross-sectional front elevation view of a first exemplary spike assembly attached to a sand/soil bag.

FIG. 35 is a diagrammatic representation of a partial cross-sectional front elevation view of a first exemplary spike assembly 3510 attached to a sand/soil bag 120.

Figure 36:
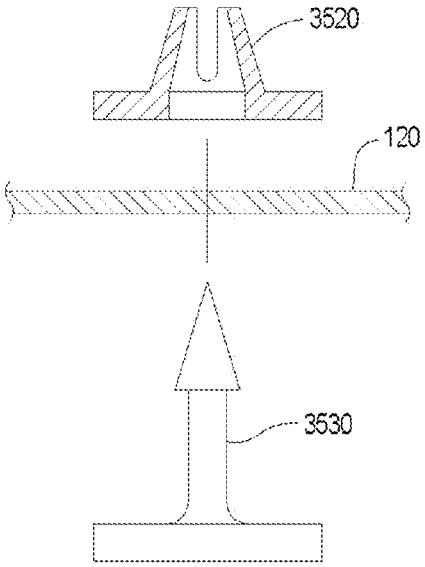
FIG. 36 is a diagrammatic representation of a cross-sectional exploded elevation view of the spike assembly FIG. 35 with a portion of the sand/soil bag also shown in cross-section.
Figure 37:
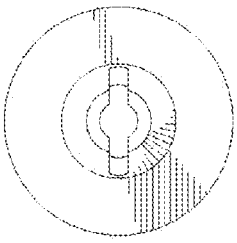
FIG. 37 is a diagrammatic representation of a top plan view of a spike housing of the spike assembly of FIG. 35.

FIG. 36 is a diagrammatic representation of a cross-sectional exploded elevation view of the spike assembly 3510 of FIG. 35 with a portion of the sand/soil bag 120 also shown in cross-section. As shown in FIG. 36, the spike assembly 3510 includes a first portion 3520 and a second portion 3530. FIG. 37 is a diagrammatic representation of a top plan view of a portion of the spike assembly 3510 of FIG. 35.

Figure 38:
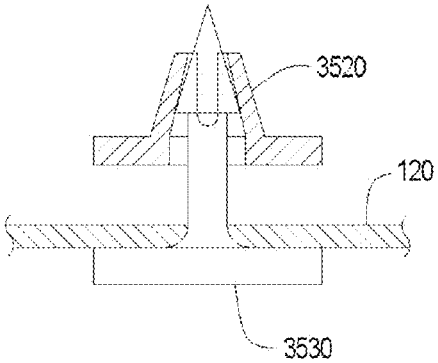
FIG. 38 is a diagrammatic representation of a cross-sectional partially assembled elevation view of the spike assembly of FIG. 35 with a portion of the sand/soil bag also shown in cross-section.
Figure 39:
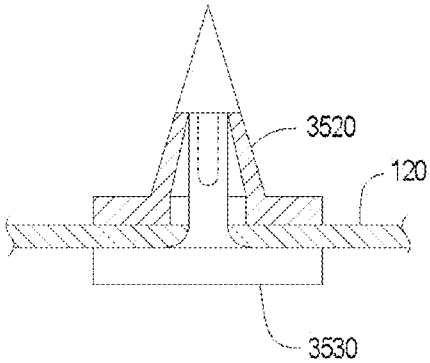
FIG. 39 is a diagrammatic representation of a cross-sectional assembled elevation view of the spike assembly of FIG. 35 with a portion of the sand/soil bag also shown in cross-section.

FIG. 38 is a diagrammatic representation of a cross-sectional partially assembled elevation view of the spike assembly 3510 of FIG. 35 with a portion of the sand/soil bag 120 also shown in cross-section. FIG. 39 is a diagrammatic representation of a cross-sectional assembled elevation view of the spike assembly 3510 of FIG. 35 with a portion of the sand/soil bag 120 also shown in cross-section.

The manner of assembling the spike assembly 3510 is easily understood upon viewing FIGS. 36, 38 and 39. Specifically, the second portion 3530 is pushed through the sand/soil bag 120. Then, the first portion 3520 is placed over the tip of the second portion 3520. The first portion 3520 is flexible, but resilient, and allows the tip of the second portion 3530 to be pushed therethrough. Once the second portion 3530 has been completely received within first portion 3520, the first and second portions 3520, 3530 of the spike assembly 3510 are effectively locked together.

Figure 40:
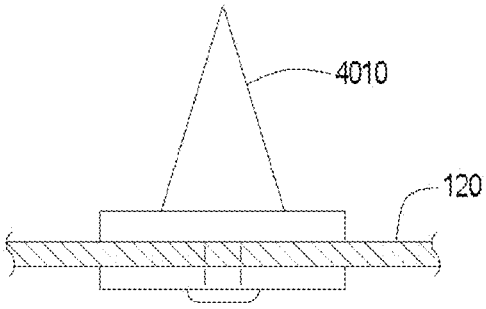
FIG. 40 is a diagrammatic representation of a partial cross-sectional front elevation view of a second exemplary spike assembly with a portion of the sand/soil bag also shown in cross-section.
Figure 41:
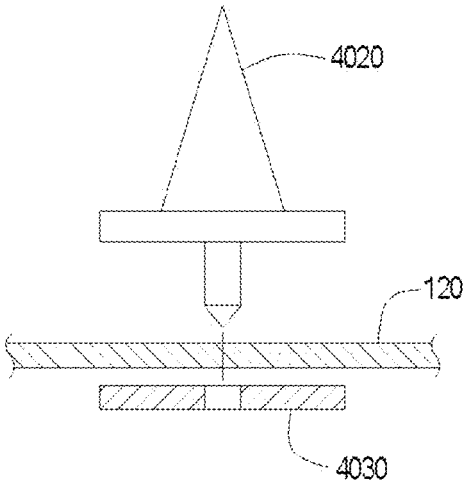
FIG. 41 is a diagrammatic representation of a cross-sectional exploded elevation view of the spike assembly of FIG. 40 with a portion of the sand/soil bag also shown in cross-section.

FIG. 40 is a diagrammatic representation of a partial cross-sectional front elevation view of a second exemplary spike assembly 4010 with a portion of the sand/soil bag 120 also shown in cross-section. FIG. 41 is a diagrammatic representation of a partial cross-sectional exploded elevation view of the spike assembly 4010 of FIG. 40 with a portion of the sand/soil bag 120 also shown in cross-section. The spike assembly 4010 includes a first portion 4020 and a second portion 4030 which interconnect with one another.

Figure 42:
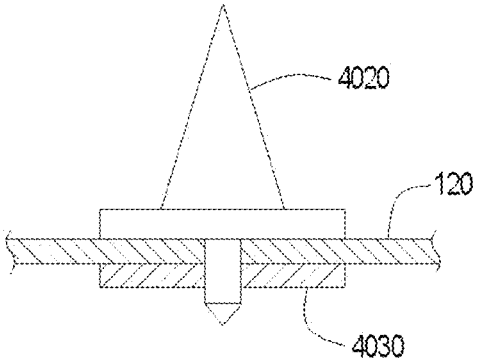
FIG. 42 is a diagrammatic representation of a cross-sectional partially assembled elevation view of the spike assembly of FIG. 40 with a portion of the sand/soil bag also shown in cross-section.
Figure 43:
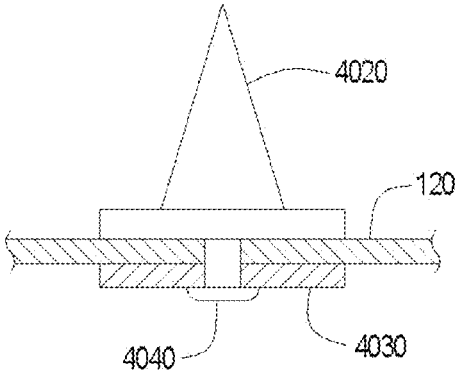
FIG. 43 is a diagrammatic representation of a cross-sectional assembled elevation view of the spike assembly of FIG. 40 with a portion of the sand/soil bag also shown in cross-section.

FIG. 42 is a diagrammatic representation of a cross-sectional partially assembled elevation view of the spike assembly 4010 of FIG. 40 with a portion of the sand/soil bag 120 also shown in cross-section. FIG. 43 is a diagrammatic representation of a cross-sectional assembled elevation view of the spike assembly 4010 of FIG. 40 with a portion of the sand/soil bag 120 also shown in cross-section.

The manner of assembling the spike assembly 4010 is easily understood upon viewing FIGS. 40-43. Specifically, the first portion 4020 is pushed through the sand/soil bag 120. Then, the second portion 4030 is placed over the tip of the first portion 4020. A cap 4040 may be placed over the tip of the first portion 4020 to lock the spike assembly 4010 in place. The cap 4040 may be integrated with second portion 4030 or a separate piece.

Figure 44:
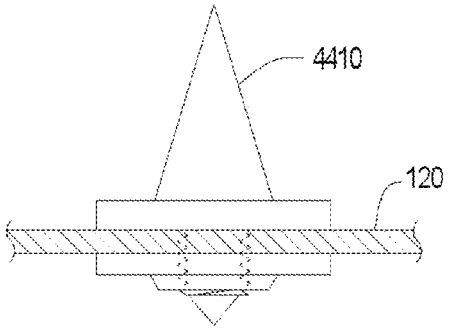
FIG. 44 is a diagrammatic representation of a cross-sectional front elevation view of a third exemplary spike assembly with a portion of the sand/soil bag also shown in cross-section.
Figure 45:
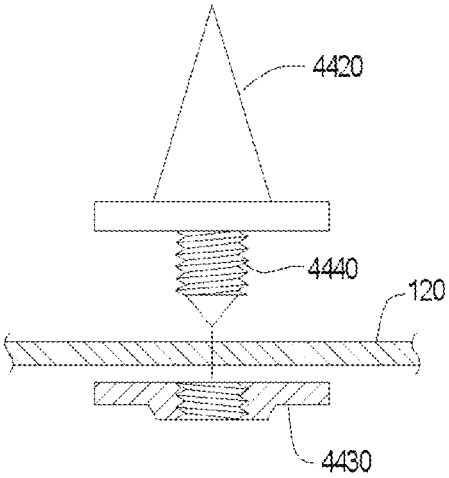
FIG. 45 is a diagrammatic representation of a cross-sectional exploded elevation view of the spike assembly of FIG. 44 with a portion of the sand/soil bag also shown in cross-section.

FIG. 44 is a diagrammatic representation of a cross-sectional front elevation view of a third exemplary spike assembly 4410 with a portion of the sand/soil bag 120 also shown in cross-section. FIG. 45 is a diagrammatic representation of a cross-sectional exploded elevation view of the spike assembly 4410 of FIG. 44 with a portion of the sand/soil bag 120 also shown in cross-section. The spike assembly 4410 includes a first portion 4420 and a second portion 4430 which interconnect with one another.

Figure 46:
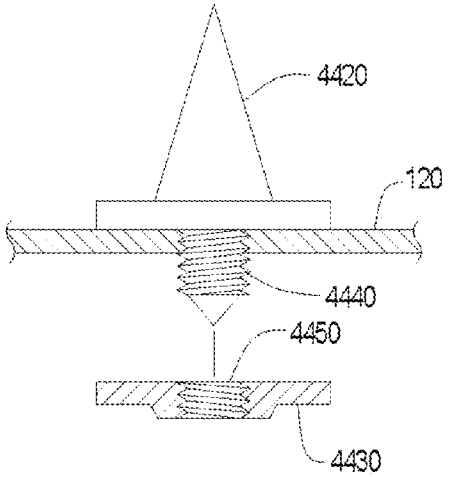
FIG. 46 is a diagrammatic representation of a cross-sectional partially assembled elevation view of the spike assembly of FIG. 44 with a portion of the sand/soil bag also shown in cross-section.
Figure 47:
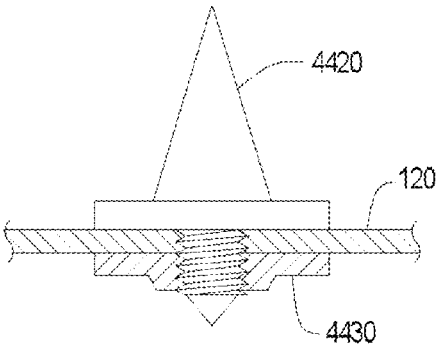
FIG. 47 is a diagrammatic representation of a cross-sectional assembled elevation view of the spike assembly of FIG. 44 with a portion of the sand/soil bag also shown in cross-section.

FIG. 46 is a diagrammatic representation of a cross-sectional partially assembled elevation view of the spike assembly 4410 of FIG. 44 with a portion of the sand/soil bag 120 also shown in cross-section. FIG. 47 is a diagrammatic representation of a cross-sectional assembled elevation view of the spike assembly 4410 of FIG. 44 with a portion of the sand/soil bag 120 also shown in cross-section.

The manner of assembling the spike assembly 4410 is easily understood upon viewing FIGS. 44-47. Specifically, the first portion 4420 includes a threaded shaft 4440, which is pushed through the sand/soil bag 120. Then, the second portion 4430, which includes a corresponding threaded aperture 4450 is placed over the tip of the shaft 4440 of the first portion 4420. The threaded shaft 4440 and the threaded aperture 4450 are rotated relative to one another to tighten. Accordingly, the first portion 4420 and the second portion 4430 become connected to one another.

Figure 48:
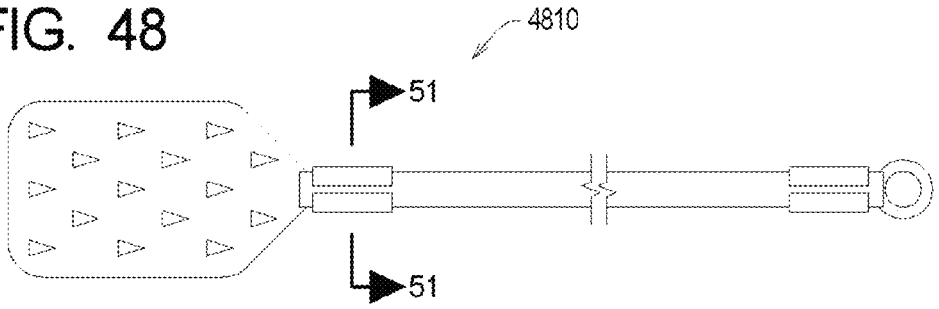
FIG. 48 is a diagrammatic representation of a top plan view of a first exemplary anchor/strap assembly in accordance with an embodiment of the invention.
Figure 49:
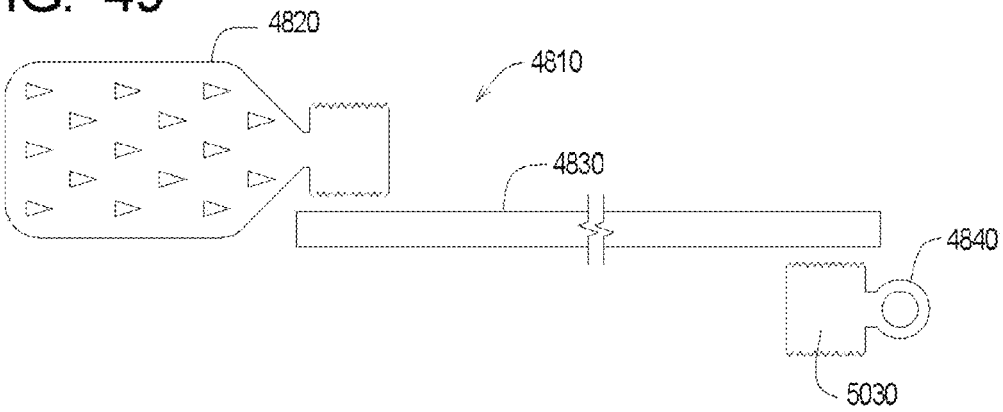
FIG. 49 is a diagrammatic representation of an exploded top plan view of the anchor/strap assembly of FIG. 48.

FIG. 48 is a diagrammatic representation of a top plan view of a first exemplary anchor/strap assembly 4810 in accordance with an embodiment of the invention. FIG. 49 is a diagrammatic representation of an exploded top plan view of the anchor/strap assembly 4810 of FIG. 48. The anchor/strap assembly 4810 includes an anchor plate 4820, a strap 4830 and a loop plate 4840.

Figure 50:
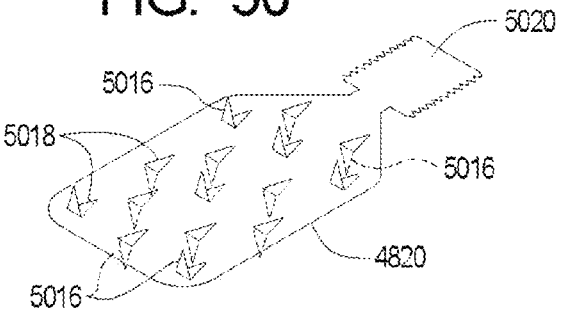
FIG. 50 is a diagrammatic representation of an isometric top view of the anchor plate of FIG. 48.

FIG. 50 is a diagrammatic representation of an isometric top view of the anchor plate 4820 of FIG. 48. The anchor plate 4820 includes projections 5016, which are used to connect the anchor/strap assembly 4810 to a sand/soil bag 120.

In one embodiment, the anchor plate 4820 is made of metal and the projections 5016 are formed by punching triangular holes 5018 in the anchor plate 4820. The anchor plate 4820 also includes a plate attachment member 5020. Similarly, the loop plate 4840 includes a loop attachment member 5030.

Figure 51:
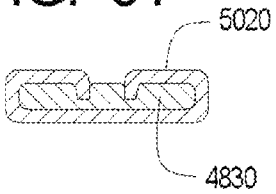
FIG. 51 is a diagrammatic representation of a cross-sectional view taken along line 51-51 of FIG. 48 and illustrates the connection between the anchor plate and the strap.

FIG. 51 is a diagrammatic representation of a cross-sectional view taken along line 51-51 of FIG. 48 and illustrates the connection between the anchor plate 4820 and the strap 4830. Specifically, it shows how the plate attachment member 5020 is bent around the strap 4830 and attached thereto. The loop attachment member 5030 is bent around the other end of the strap 4830 in a similar manner, so as to attach the loop plate 4840 thereto.

Figure 52:
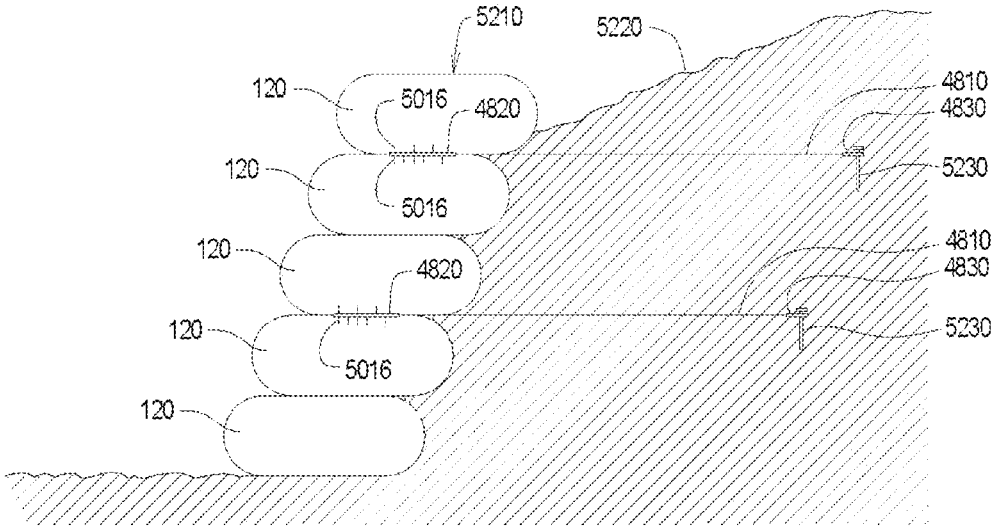
FIG. 52 is a diagrammatic representation of a schematic right end elevation of a retaining wall showing the anchor/strap assembly of FIG. 48 in use by being anchored in dirt.

FIG. 52 is a diagrammatic representation of a schematic right end elevation of a retaining wall 5210 showing the anchor/strap assembly 4810 of FIG. 48 in use by being anchored in dirt 5220. Specifically, in one embodiment, a stake 5230 is placed through the loop in the anchor/strap assembly 4810 and driven into the dirt 5220. At the other end of the anchor/strap assembly 4810, an anchor plate 4820 is placed between sand/soil bags 120 and the projections 5016 in the anchor plate serve to engage the sand/soil bags 120. Preferably, the anchor plate 4820 is placed on top of an uncovered section of a sand/soil bag 120. Then, another sand/soil bag 120 is placed on top of the anchor plate 4820.

Figure 53:
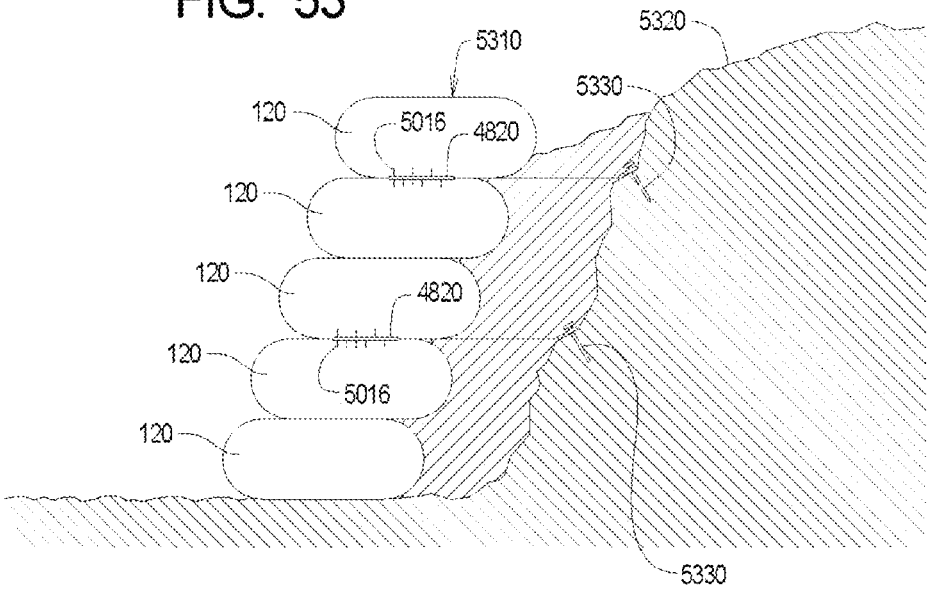
FIG. 53 is a diagrammatic representation of a schematic right end elevation of a retaining wall showing the anchor/strap assembly of FIG. 48 in use by being anchored to rock.

FIG. 53 is a diagrammatic representation of a schematic right end elevation of a retaining wall 5310 showing the anchor/strap assembly 4810 of FIG. 48 in use by being anchored to rock 5320. Specifically, in one embodiment, a stake 5330 is placed through the loop in the anchor/strap assembly 4810 and driven into the rock 5320. At the other end of the anchor/strap assembly 4810, an anchor plate 4820 is placed between sand/soil bags 120 and the projections 5016 in the anchor plate serve to engage the sand/soil bags 120. Preferably, the anchor plate 4820 is placed on top of an uncovered section of a sand/soil bag 120. Then, another sand/soil bag 120 is placed on top of the anchor plate 4820.

Figure 54:
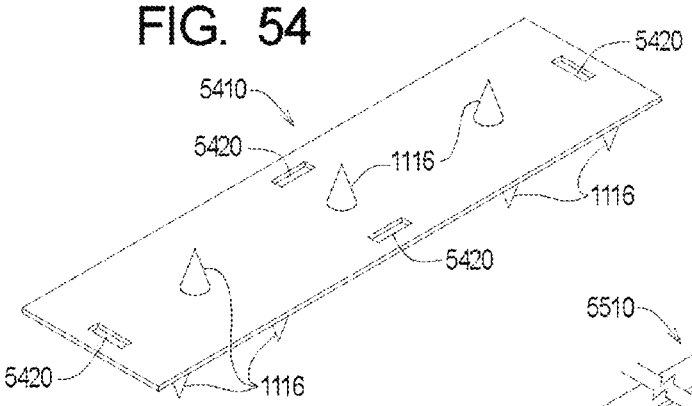
FIG. 54 is a diagrammatic representation of an isometric top view of a ninth exemplary embodiment of an interconnecting member.
Figure 55:
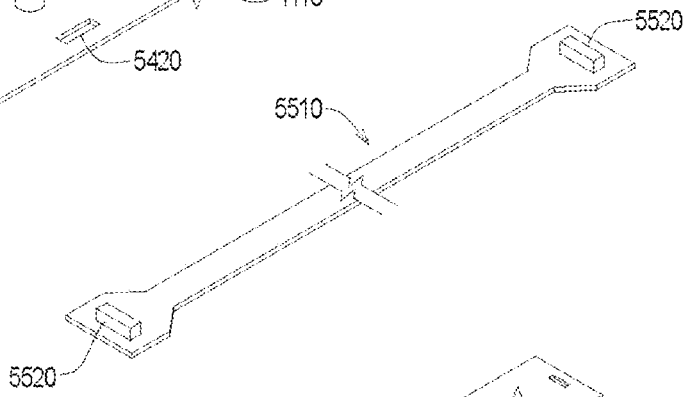
FIG. 55 is a diagrammatic representation of an isometric bottom view of an exemplary anchor strap.

FIG. 54 is a diagrammatic representation of an isometric top view of a ninth exemplary embodiment of an interconnecting member 5410 that has connection slots 5420 therein. FIG. 55 is a diagrammatic representation of an isometric bottom view of an exemplary anchor strap 5510 that cooperates with the connection slots 5420 of the interconnecting member 5401 of FIG. 54. Specifically, the anchor strap 5510 includes protrusions 5520 on each of its ends. The protrusions 5520 are sized to be received by the connection slots 5420.

Figure 56:
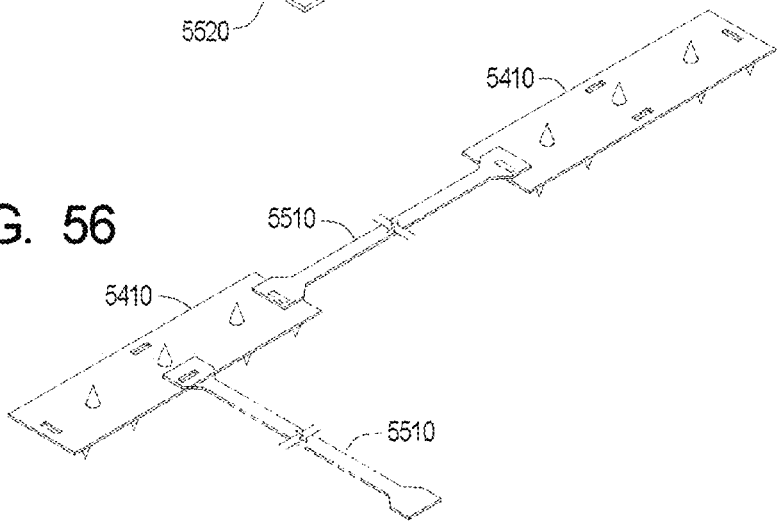
FIG. 56 is a diagrammatic representation of an isometric top view of the interconnecting member of FIG. 54 with the anchor strap of FIG. 55 attached thereto.

FIG. 56 is a diagrammatic representation of an isometric top view of a plurality of interconnecting members 5410 with an anchor strap 5510 attached thereto. FIG. 56 also shows (in phantom) one of many other locations where other anchor straps 5510 may be connected.

Figure 57:
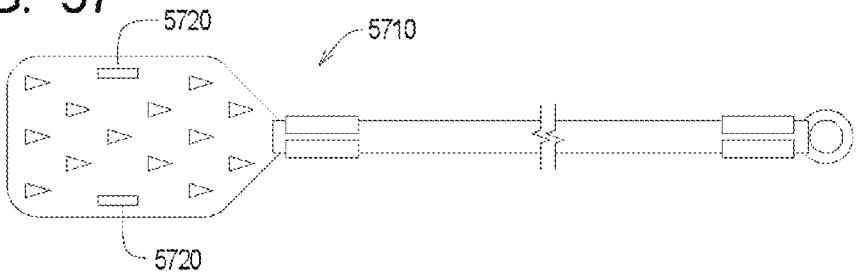
FIG. 57 is a diagrammatic representation of a top plan view of a second exemplary anchor/strap assembly in accordance with an embodiment of the invention.

FIG. 57 is a diagrammatic representation of a top plan view of a second exemplary anchor/strap assembly 5710 in accordance with an embodiment of the invention. The anchor/strap assembly 5710 is similar to the anchor/strap assembly of FIG. 48, but includes connection slots 5720 therein.

Figure 58:
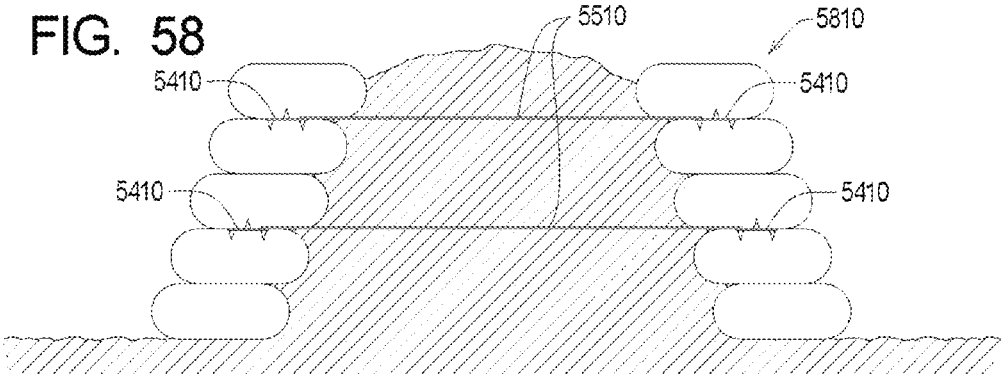
FIG. 58 is a diagrammatic representation of a schematic right end elevation of a retaining wall showing the interconnecting member of FIG. 54 used in combination with the anchor/strap assembly of FIG. 55.
Figure 59:
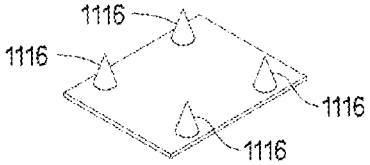
FIGS. 59-62 are diagrammatic representations of isometric top views of interconnecting members showing some exemplary projection positions.
Figure 60:
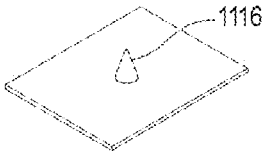
Figure 61:
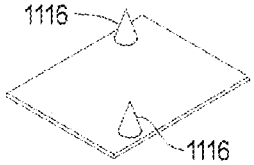
Figure 62:
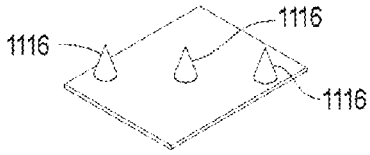

FIG. 58 is a diagrammatic representation of a schematic right end elevation of a retaining wall 5810 showing the interconnecting member 5410 of FIG. 54 used in combination with the anchor/strap assembly 5510 of FIG. 55.

FIGS. 59-62 are diagrammatic representations of sides of interconnecting members showing some exemplary projection positions and an exemplary number of projections. It should be understood that the sides of the interconnecting members shown in FIGS. 59-62 may be mixed and matched with one another. For example, an interconnecting member having an upper side like that shown in FIG. 59 may have a lower side like that shown in FIG. 62.

Figure 63:
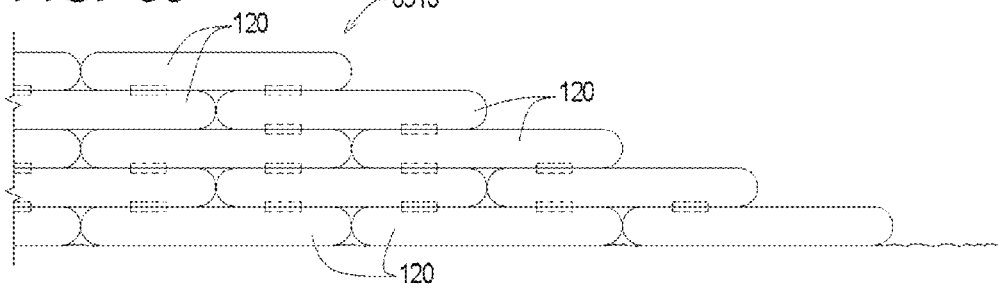
FIG. 63 is a diagrammatic representation of a front elevation view of an exemplary retaining wall using one or more of the interconnecting members shown in FIGS. 59-62 with such interconnecting members shown in broken lines.

The sides of the interconnecting members shown in FIG. 59-62 are not intended to be placed across horizontally adjacent sand/soil bags 120. More specifically, FIG. 63 is a diagrammatic representation of a front elevation view of an exemplary retaining wall 6310 using one or more of the interconnecting members shown in FIGS. 59-62 with such interconnecting members shown in broken lines. As shown in FIG. 63, none of the interconnecting members span across adjacent sand/soil bags 120.

Figure 64:
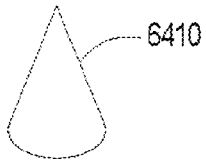
FIG. 64 is a diagrammatic representation of an isometric view of a conventional projection for a conventional interconnecting member.

FIG. 64 is a diagrammatic representation of an isometric view of a conventional projection 6410 for a conventional interconnecting member.

Figure 65:
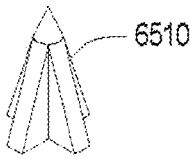
FIGS. 65 and 66 are diagrammatic representations of isometric views of exemplary projections for exemplary interconnecting members.
Figure 66:
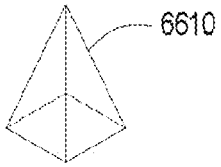

FIGS. 65 and 66 are diagrammatic representations of isometric views of exemplary projections 6510, 6610 for exemplary interconnecting members. Other shapes are possible and anticipated.

Figure 67:
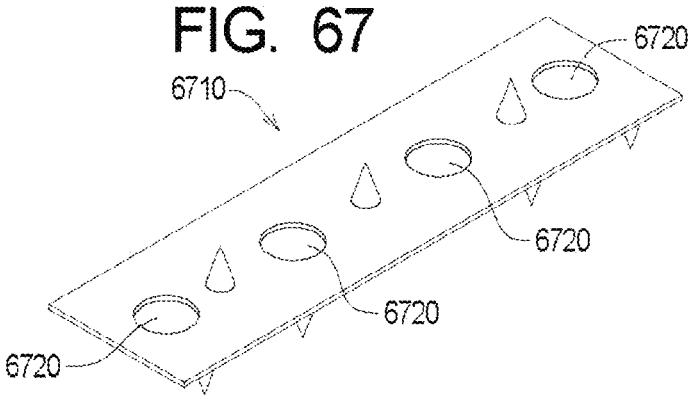
FIG. 67 is a diagrammatic representation of an isometric top view of an eleventh exemplary interconnecting member of the invention.

FIG. 67 is a diagrammatic representation of an isometric top view of an eleventh exemplary interconnecting member 6710 of the invention, which has holes 6720 through which plants may grow. In one embodiment, the holes do not need to be identical in shape or size.

Figure 68:
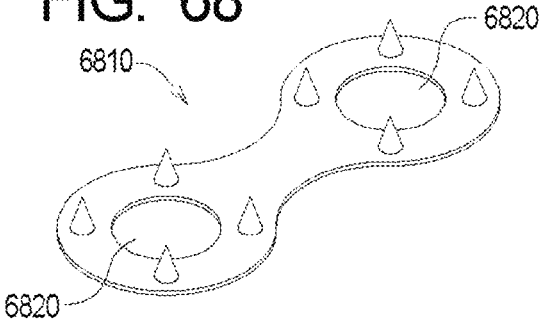
FIG. 68 is a diagrammatic representation of an isometric top view of a twelfth exemplary interconnecting member of the invention.

FIG. 68 is a diagrammatic representation of an isometric top view of a twelfth exemplary interconnecting member 6810 of the invention, which is roughly shaped like a figure eight and which has holes 6820 through which plants may grow.

Figure 69:
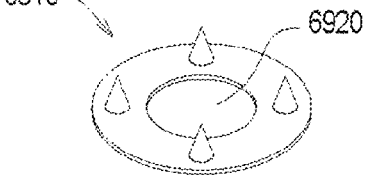
FIG. 69 is a diagrammatic representation of an isometric top view of a thirteenth exemplary interconnecting member of the invention.

FIG. 69 is a diagrammatic representation of an isometric top view of a thirteenth exemplary interconnecting member 6910 of the invention, which is roughly shaped like a zero (or donut) and which has a hole 6920 through which plants may grow.

Figure 70:
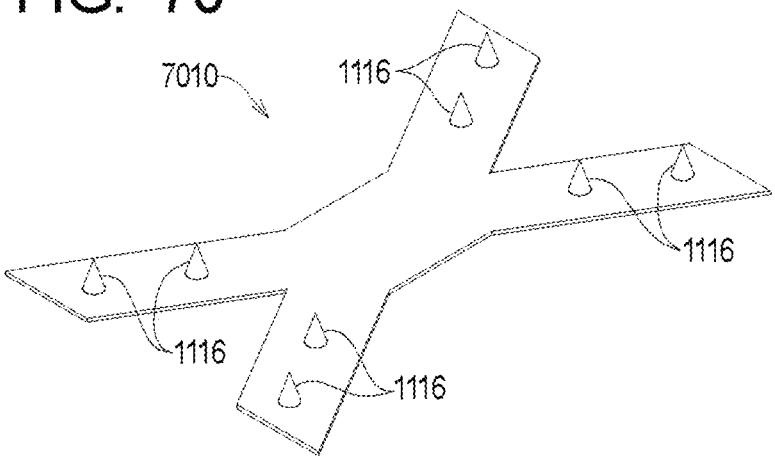
FIG. 70 is a diagrammatic representation of an isometric top view of a fourteenth exemplary interconnecting member of the invention.

FIG. 70 is a diagrammatic representation of an isometric top view of a fourteenth exemplary interconnecting member 7010 of the invention, which is roughly shaped like an X.

Figure 71:
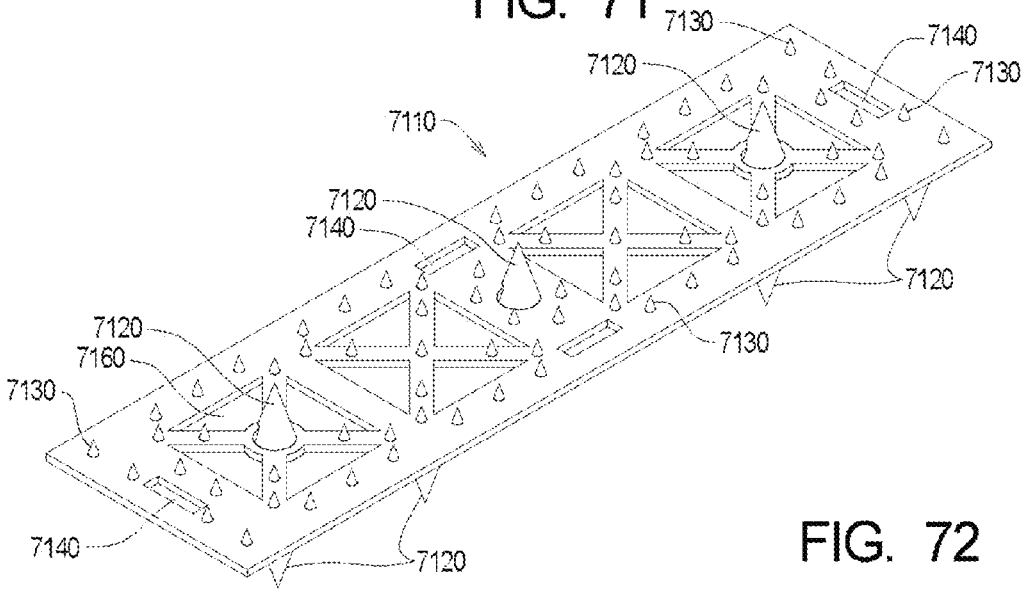
FIG. 71 is a diagrammatic representation of an isometric top view of a fifteenth exemplary interconnecting member of the invention.
Figure 72:
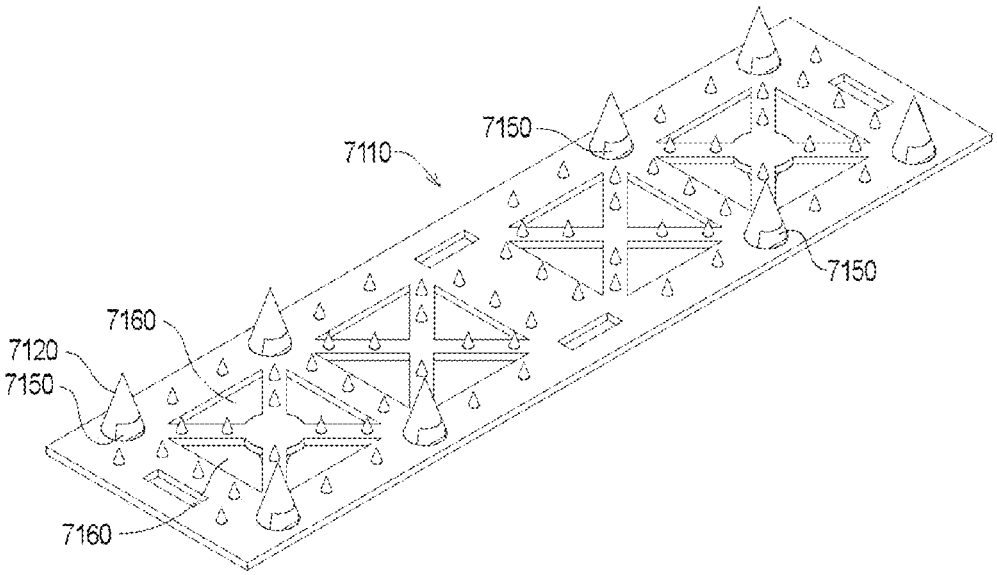
FIG. 72 is a diagrammatic representation of an isometric bottom view of the interconnecting member of FIG. 71.

FIG. 71 is a diagrammatic representation of an isometric top view of a fifteenth exemplary interconnecting member 7110 of the invention. FIG. 72 is a diagrammatic representation of an isometric bottom view of the interconnecting member 7710 of FIG. 71. The interconnecting member 7110 includes many of the features already described above, including large 7120 and small projections 7130, along with connection slots 7140. The large projections 7120 have notches 7150 therein to engage geogrid (not shown). Furthermore, the interconnecting member 7110 has a lattice-type hole pattern 7160 to permit plants to grow therethrough.

Figure 73:
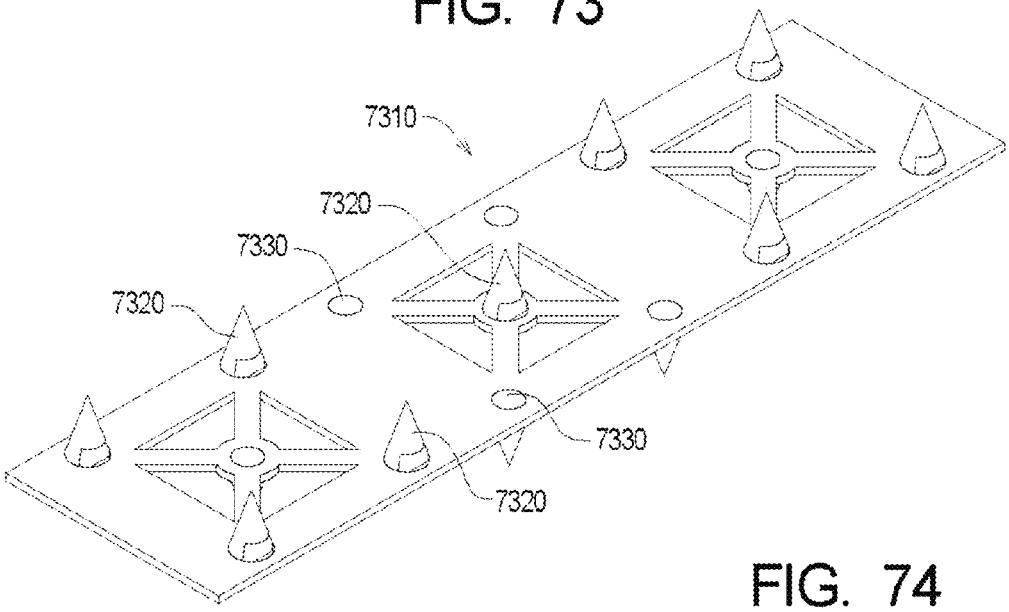
FIG. 73 is a diagrammatic representation of an isometric top view of a sixteenth exemplary interconnecting member of the invention.
Figure 74:
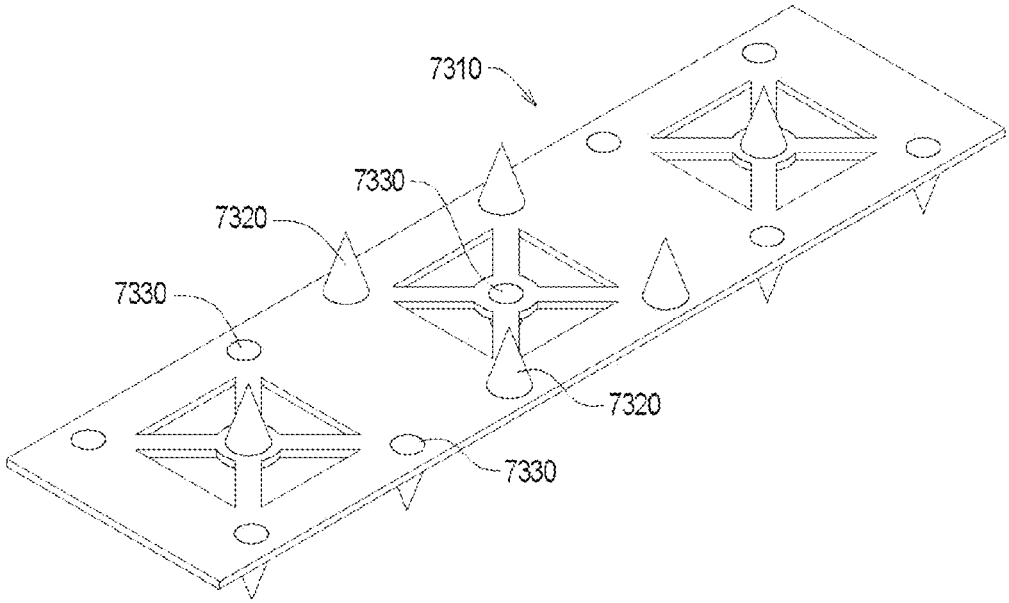
FIG. 74 is a diagrammatic representation of an isometric bottom view of the interconnecting member of FIG. 73.

FIG. 73 is a diagrammatic representation of an isometric top view of a sixteenth exemplary interconnecting member 7310 of the invention. FIG. 74 is a diagrammatic representation of an isometric bottom view of the interconnecting member 7310 of FIG. 73. Unlike the interconnecting member 7110 shown in FIG. 71, the projections 7320 of the interconnecting member 7310 have corresponding recesses 7330, so as to promote the stackability of the interconnecting members 7310.

Figure 75:
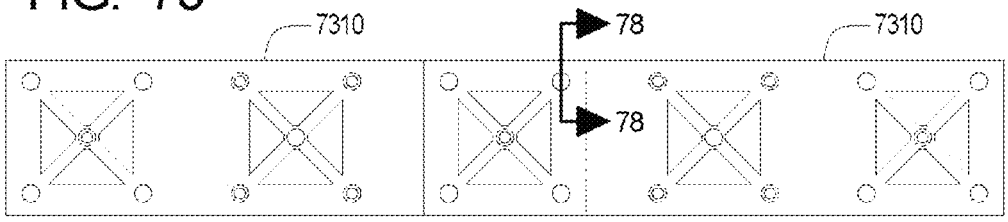
FIG. 75 is a diagrammatic representation of a top plan view of two exemplary interconnecting members that have been connected to one another in a first configuration.
Figure 76:
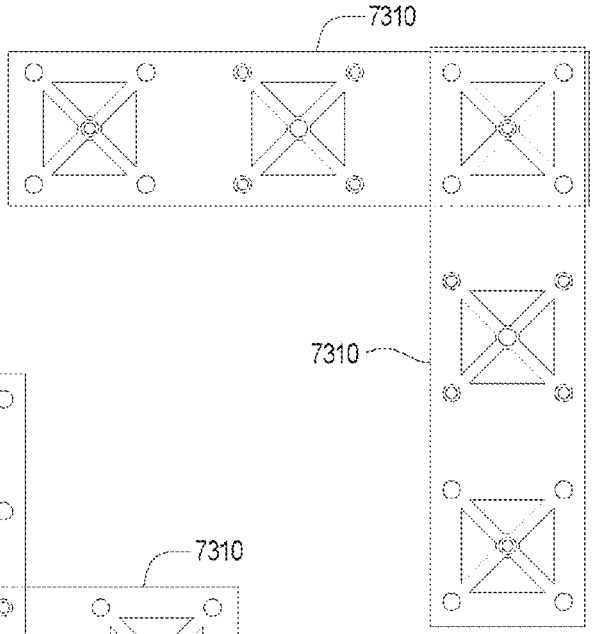
FIG. 76 is a diagrammatic representation of a top plan view of two exemplary interconnecting members that have been connected to one another in a second configuration.
Figure 77:
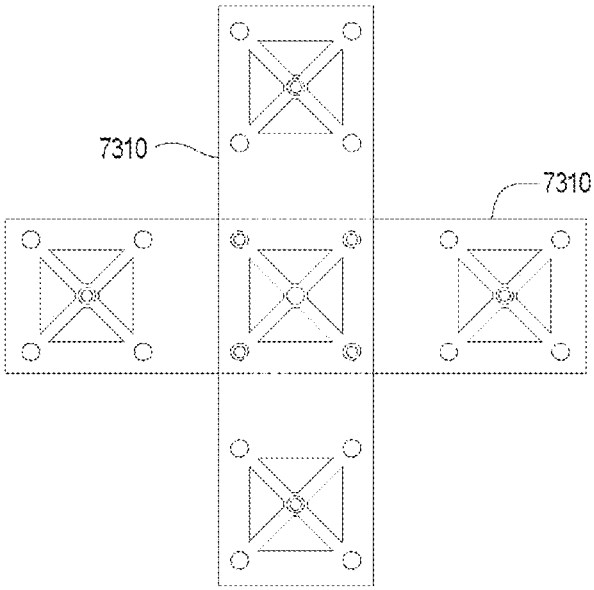
FIG. 77 is a diagrammatic representation of a top plan view of two exemplary interconnecting members that have been connected to one another in a third configuration.

FIG. 75 is a diagrammatic representation of a top plan view of two exemplary interconnecting members (e.g., interconnecting members 7310) that have been connected to one another in a first configuration. FIG. 76 is a diagrammatic representation of a top plan view of two exemplary interconnecting members (e.g., interconnecting members 7310) that have been connected to one another in a second configuration. FIG. 77 is a diagrammatic representation of a top plan view of two exemplary interconnecting members (e.g., interconnecting members 7310) that have been connected to one another in a third configuration.

Figure 78:
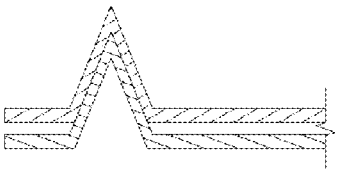
FIG. 78 is a diagrammatic representation of a cross-sectional view taken along line 78-78 of FIG. 75.

FIG. 78 is a diagrammatic representation of a cross-sectional view taken along line 78-78 of FIG. 75. FIG. 78 shows how a projection (like projection 7320) is received in a recess (like recess 7330).

Figure 79:
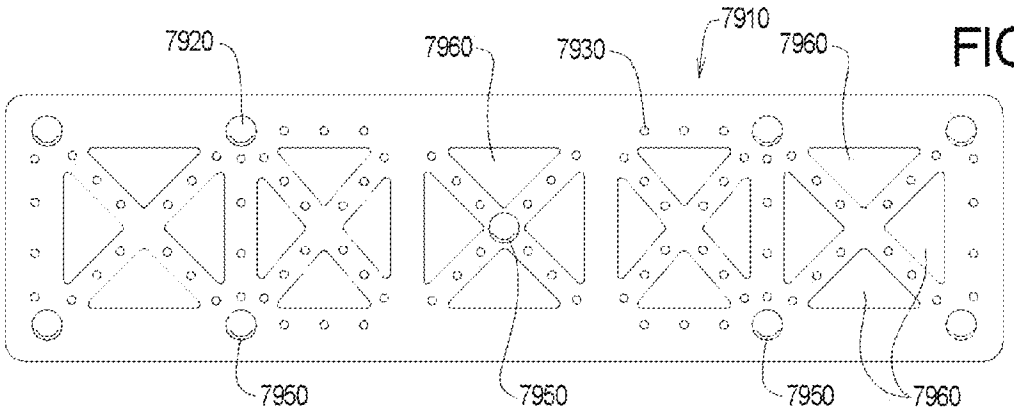
FIG. 79 is a diagrammatic representation of a top plan view of a seventeenth exemplary interconnecting member of the invention.
Figure 80:
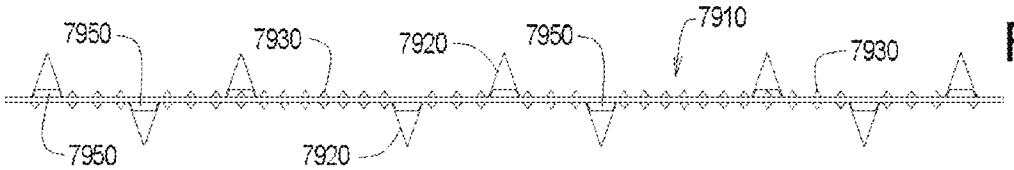
FIG. 80 is a diagrammatic representation of a front elevation view of the interconnecting member of FIG. 79.
Figure 81:
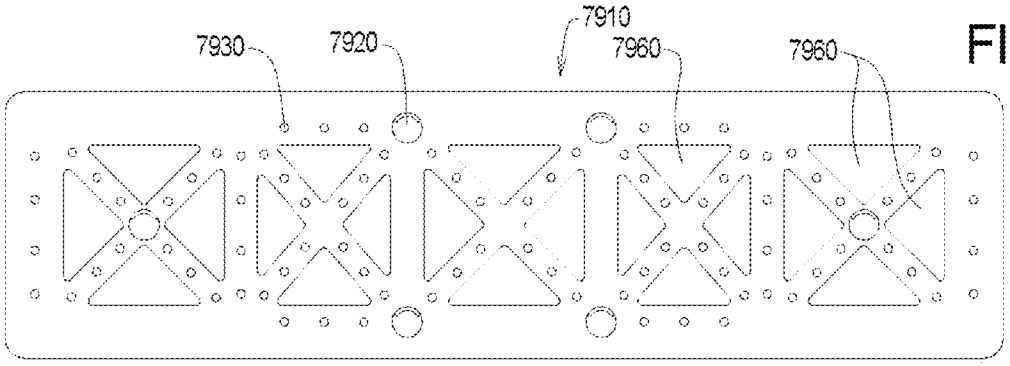
FIG. 81 is a diagrammatic representation of a bottom plan view of the interconnecting member of FIG. 79.

FIG. 79 is a diagrammatic representation of a top plan view of a seventeenth exemplary interconnecting member of the invention. FIG. 80 is a diagrammatic representation of a front elevation view of the interconnecting member of FIG. 79. FIG. 81 is a diagrammatic representation of a bottom plan view of the interconnecting member of FIG. 79. The interconnecting member 7910 includes many of the features already described above, including large 7920 and small projections 7930. The large projections 7920 have notches 7950 therein to engage geogrid (not shown). Furthermore, the interconnecting member 7910 has a lattice-type hole pattern 7960 to permit plants to grow therethrough.

Figure 82:
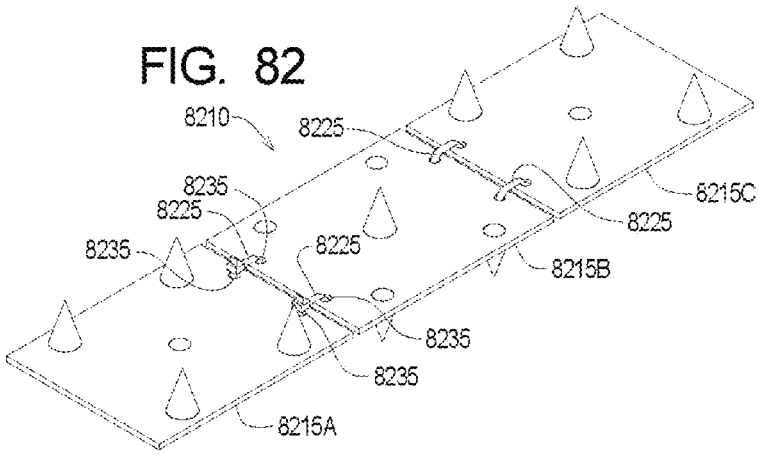
FIG. 82 is a diagrammatic representation of an isometric view of an eighteenth exemplary interconnecting member of the invention, wherein the interconnecting member includes a plurality of plates that are connected together by fastening members that are threaded through apertures in the plates.

FIG. 82 is a diagrammatic representation of an isometric view of an eighteenth exemplary interconnecting member 8210 of the invention. The interconnecting member includes a plurality of plates 8215A, 8215B, 8215C that are connected together by fastening members 8225 that are threaded through apertures 8235 in the plates 8215A, 8215B, 8215C. The fastening members 8225 may take a variety of forms. Cable ties are shown in FIGS. 82-85, but the invention is not limited to cable ties.

Figure 83:
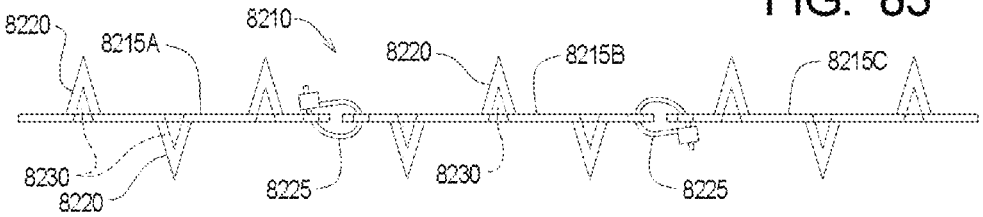
FIG. 83 is a diagrammatic representation of a front elevation view of the interconnecting member of FIG. 82.
Figure 84:
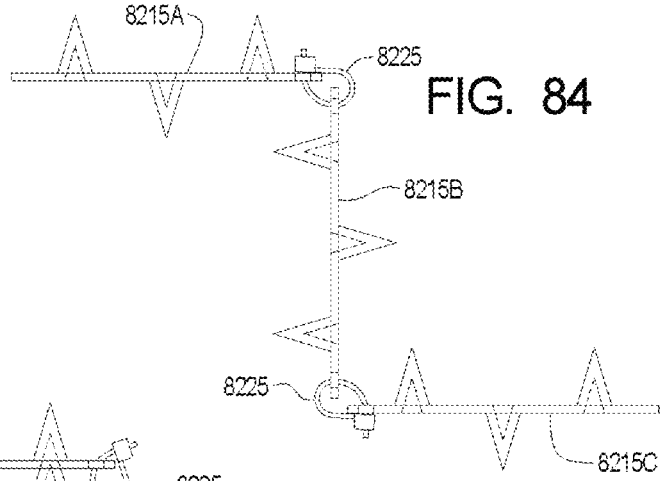
FIG. 84 is a diagrammatic representation similar to FIG. 83, except that the plates of the interconnecting member have been pivoted.
Figure 85:
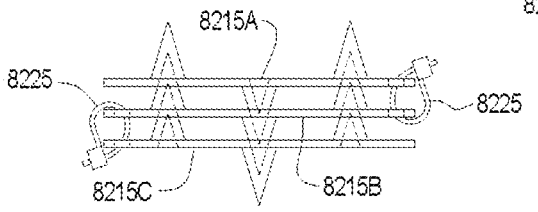
FIG. 85 is a diagrammatic representation similar to FIG. 84, except that the plates have been stacked on top of one another; and, FIG. 86 is a diagrammatic representation of a nineteenth exemplary interconnecting member of the invention, wherein the interconnecting member includes a plurality of spike balls that are connected together by a fastener.

FIG. 83 is a diagrammatic representation of a front elevation view of the interconnecting member 8210 of FIG. 82. FIG. 84 is a diagrammatic representation similar to FIG. 83, except that the plates 8215A, 8215B, 8215C of the interconnecting member have been pivoted relative to one another. FIG. 85 is a diagrammatic representation similar to FIG. 84, except that the plates 8215A, 8215B, 8215C have been stacked on top of one another. In one embodiment, projections 8220 from one plate correspond with recesses 8230 under projections 8220 in another plate, so that the plates can be easily stacked on top of one another. In one embodiment, each plate includes no more than one projection on one of its sides and a plurality of projections on the other of its sides. Of course, in other embodiments, other combinations of projections are possible.

Figure 86:
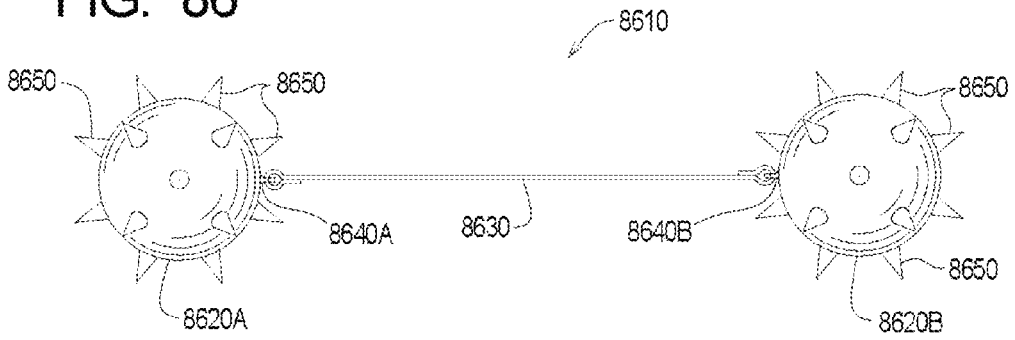

FIG. 86 is a diagrammatic representation of a nineteenth exemplary interconnecting member 8610 of the invention. In this embodiment, the interconnecting member 8610 includes first and second spike balls 8620A, 8620B that are connected together by a fastener 8630. The first spike ball 8620A includes a loop or hook 8640A and the second spike ball 8620B includes a loop or hook 8640B. The fastener 8630 is attached to the loops or hooks 8640A, 8640B, so as to connect the first and second spike balls 8620A, 8620B together. The spike balls 8620A, 8620B include projections 8650, which are similar to projections 1116. In one embodiment, the first and second spike balls 8620A, 8620B are made of plastic and the fastener 8630 is made of plastic.

In one embodiment, the interconnecting member includes only a single spike ball. In one embodiment, the interconnecting member includes more than two spike balls of which at least two are connected to each other. In one embodiment, at least one spike ball includes more than one loop or hook.

Several embodiments of the invention have been described. It should be understood that the concepts described in connection with one embodiment of the invention may be combined with the concepts described in connection with another embodiment (or other embodiments) of the invention.

While an effort has been made to describe some alternatives to the preferred embodiment, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A retaining wall system comprising:

a first horizontally-extending course of sand/soil bags;

a second horizontally-extending course of sand/soil bags positioned vertically adjacent to the first course of sand/soil bags;

an interconnecting member that attaches the first course of sand/soil bags to the second course of sand/soil bags, wherein the interconnecting member has an upper side and a lower side, wherein at least one of the upper side and the lower side has a first projection that includes a notch therein to engage geogrid, wherein the first projection has a conical shape that extends from a base to a tip, wherein, in the absence of the notch, the first projection has a radius that continuously decreases from the base of the first projection to the tip of the first projection, wherein the base of the first projection is located immediately adjacent to at least one of the upper side or lower side, and wherein the notch is located between the base of the first projection and the tip of the first projection.

2. The retaining wall system of claim 1, wherein at least one of the upper side and the lower side also includes a second projection, that is smaller than the first projection, but which does not include a notch therein to engage geogrid.

3. The retaining wall system of claim 1, wherein the interconnecting member has at least one connection slot therein.

4. The retaining wall system of claim 1, wherein the upper side has two large projections therein and the lower side has one large projection.

5. The retaining wall system of claim 4, wherein the two large projections are spaced apart such that each engages a different bag in the second course of sand/soil bags.

6. The retaining wall system of claim 1, wherein the interconnecting member includes a lattice-type hole pattern to permit plant growth therethrough.

7. The retaining wall system of claim 2, wherein the interconnecting member includes a plurality of first projections of a first height and a plurality of second projections of a second height, wherein the second height is less than the first height.

8. The retaining wall system of claim 7, wherein the interconnecting member includes a plurality of recesses that correspond with the plurality of first projections, such that two or more interconnecting members may be arranged in a linear configuration or a transverse configuration.

9. The retaining wall system of claim 8, wherein the linear configuration or transverse configuration is achieved by aligning a plurality of first projections in a first interconnecting member with a plurality of recesses in the second interconnecting member.

10. The retaining wall system of claim 1, further including a geogrid-holding member that extends in a direction perpendicular to a direction in which the first projection extends.

11. The retaining wall system of claim 10, wherein the interconnecting member has at least one edge and at least one geogrid-holding member extends from the at least one edge.

12. The retaining wall system of claim 11, wherein a plurality of geogrid-holding members extend from at least one edge of the interconnecting member.

13. A retaining wall system comprising:

a first horizontally-extending course of sand/soil bags;

a second horizontally-extending course of sand/soil bags positioned vertically adjacent to the first course of sand/soil bags;

an interconnecting member that attaches the first course of sand/soil bags to the second course of sand/soil bags, wherein the interconnecting member includes a plurality of plates each having at least one aperture therethrough so that adjacent plates may be connected together by fastening members, wherein in a first configuration connected plates are within a common plane, wherein each plate has an upper side and a lower side, wherein at least one of the upper side and lower side of each plate has at least one projection on one of the upper side or lower side and at least one corresponding recess on the other side, so that connected plates may be pivoted relative to each other and into a second configuration, where connected plates are stacked on top of each other, wherein the at least one projection includes a notch therein to engage geogrid and has a conical shape that extends from a base to a tip, wherein, in the absence of the notch, the at least one projection has a radius that continuously decreases from the base of the at least one projection to the tip of the at least one projection, wherein the base of the at least one projection is located immediately adjacent to at least one of the upper side or lower side, and wherein the notch is located between the base of the at least one projection and the tip of the at least one projection.

14. The retaining wall system of claim 13, wherein at least one of the upper side and the lower side of each plate only has a single projection thereon.

15. The retaining wall system of claim 13, wherein at least one plate includes a projection that has a notch therein to engage geogrid.

16. The retaining wall system of claim 13, wherein at least one plate includes a second projection, that is smaller than the first projection, but which does not include a notch therein to engage geogrid.

17. The retaining wall system of claim 13, wherein at least one of the plates of the interconnecting member has at least one connection slot therein.

18. The retaining wall system of claim 13, wherein at least one of the plates of the interconnecting member includes a lattice-type hole pattern to permit plant growth therethrough.

19. The retaining wall system of claim 13, further including a geogrid-holding member that extends in a direction perpendicular to a direction in which the first projection extends.

20. The retaining wall system of claim 19, wherein a plurality of geogrid-holding members extend from at least one edge of the interconnecting member.

21. The retaining wall system of claim 13, wherein the upper side of adjacent plates have an unequal number of projections.

22. The retaining wall system of claim 13, wherein the upper side and lower side of adjacent plates have an equal number of projections.

23. The retaining wall system of claim 13, wherein the upper side and lower side of each plate has an unequal number of projections.

24. A retaining wall system comprising:

a first horizontally-extending course of sand/soil bags;

a second horizontally-extending course of sand/soil bags positioned vertically adjacent to the first course of sand/soil bags;

an interconnecting member that attaches the first course of sand/soil bags to the second course of sand/soil bags, wherein the interconnecting member has an upper side defining a first plane and a lower side defining a second plane, wherein at least one of the upper side and the lower side has a first projection;

at least one geogrid-holding member that extends in a direction perpendicular to a direction in which the first projection extends, wherein the interconnecting member has at least one edge, wherein at least one geogrid-holding member extends from the at least one edge, and wherein the at least one geogrid-holding member is entirely within the first and second planes.

25. A retaining wall system comprising:

a first horizontally-extending course of sand/soil bags;

a second horizontally-extending course of sand/soil bags positioned vertically adjacent to the first course of sand/soil bags;

an interconnecting member that attaches the first course of sand/soil bags to the second course of sand/soil bags, wherein the interconnecting member includes a plate having an upper side and a lower side, wherein at least one of the upper side and lower side has a projection on one of the upper side or the lower side and a corresponding recess on the other side, so that a plurality of interconnecting members can be stacked on top of each other and aligned such that the plates are parallel to each other;

wherein the projection has a conical shape that extends from a base to a tip, wherein, in the absence of the notch, the first projection has a radius that continuously decreases from the base of the projection to the tip of the projection, wherein the base of the projection is located immediately adjacent to at least one of the upper side or lower side, and wherein the notch is located between the base of the projection and the tip of the projection.

* * * * *